US009759227B2

(12) United States Patent
Schurr et al.

(10) Patent No.: US 9,759,227 B2
(45) Date of Patent: Sep. 12, 2017

(54) AIRFOIL SHAPE FOR A COMPRESSOR

(71) Applicant: GENERAL ELECTRIC COMPANY, Schenectady, NY (US)

(72) Inventors: Edward Charles Schurr, Simpsonville, SC (US); Svitlana Kalmyk, Greenville, SC (US)

(73) Assignee: General Electric Company, Schenectady, NY (US)

( * ) Notice: Subject to any disclaimer, the term of this patent is extended or adjusted under 35 U.S.C. 154(b) by 273 days.

(21) Appl. No.: 14/845,370

(22) Filed: Sep. 4, 2015

(65) Prior Publication Data

US 2017/0067478 A1 Mar. 9, 2017

(51) Int. Cl.
*F04D 29/32* (2006.01)

(52) U.S. Cl.
CPC ..... *F04D 29/324* (2013.01)

(58) Field of Classification Search
CPC ..... F04D 29/324; F05D 2250/74
USPC ..... 416/243
See application file for complete search history.

(56) References Cited

U.S. PATENT DOCUMENTS

| | | | |
|---|---|---|---|
| 5,980,209 | A | 11/1999 | Barry et al. |
| 7,186,090 | B2 | 3/2007 | Tomberg et al. |
| 7,329,092 | B2 | 2/2008 | Keener et al. |
| 7,354,243 | B2 | 4/2008 | Harvey |
| 7,384,243 | B2 | 6/2008 | Noshi |
| 7,396,211 | B2 | 7/2008 | Tomberg et al. |
| 7,467,926 | B2 | 12/2008 | Stampfli et al. |
| 7,494,321 | B2 | 2/2009 | Latimer et al. |
| 7,494,322 | B2 | 2/2009 | Spracher et al. |
| 7,494,323 | B2 | 2/2009 | Douchkin et al. |
| 7,497,665 | B2 | 3/2009 | King et al. |
| 7,510,378 | B2 | 3/2009 | LaMaster et al. |
| 7,513,748 | B2 | 4/2009 | Shrum et al. |
| 7,513,749 | B2 | 4/2009 | Duong et al. |
| 7,517,188 | B2 | 4/2009 | McGowan et al. |
| 7,517,190 | B2 | 4/2009 | Latimer et al. |
| 7,517,193 | B2 | 4/2009 | Higashimori |
| 7,517,196 | B2 | 4/2009 | Shrum et al. |
| 7,517,197 | B2 | 4/2009 | Duong et al. |
| 7,520,729 | B2 | 4/2009 | McGowan et al. |
| 7,523,603 | B2 | 4/2009 | Hagen et al. |
| 7,524,170 | B2 | 4/2009 | Devangada et al. |

(Continued)

FOREIGN PATENT DOCUMENTS

| | | |
|---|---|---|
| EP | 1916383 A2 | 4/2008 |
| EP | 1916384 A2 | 4/2008 |

(Continued)

*Primary Examiner* — Dwayne J White
*Assistant Examiner* — Justin Pruitt
(74) *Attorney, Agent, or Firm* — Eversheds Sutherland (US) LLP

(57) ABSTRACT

An article of manufacture having a nominal airfoil profile substantially in accordance with Cartesian coordinate values of X, Y, and Z set forth in a scalable TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete airfoil shape.

20 Claims, 2 Drawing Sheets

(56) References Cited

U.S. PATENT DOCUMENTS

| | | | |
|---|---|---|---|
| 7,530,793 | B2 | 5/2009 | Huskins et al. |
| 7,534,092 | B2 | 5/2009 | Columbus et al. |
| 7,534,093 | B2 | 5/2009 | Spracher et al. |
| 7,534,094 | B2 | 5/2009 | Tomberg et al. |
| 7,537,434 | B2 | 5/2009 | Cheruku et al. |
| 7,537,435 | B2 | 5/2009 | Radhakrishnan et al. |
| 7,540,715 | B2 | 6/2009 | Latimer et al. |
| 7,566,202 | B2 | 7/2009 | Noshi et al. |
| 7,568,892 | B2 | 8/2009 | Devangada et al. |
| 7,572,104 | B2 | 8/2009 | Hudson et al. |
| 7,572,105 | B2 | 8/2009 | Columbus et al. |
| 7,753,649 | B2 | 7/2010 | Micheli |
| 8,591,193 | B2 | 11/2013 | Kathika et al. |
| 8,926,287 | B2 | 1/2015 | Dutka et al. |
| 8,936,441 | B2 | 1/2015 | McKeever et al. |
| 9,145,777 | B2 * | 9/2015 | Dutka |
| 2007/0177980 | A1 | 8/2007 | Keener et al. |
| 2007/0224073 | A1 | 9/2007 | Masuda |
| 2007/0231147 | A1 | 10/2007 | Tomberg et al. |
| 2007/0286718 | A1 | 12/2007 | Stampfli et al. |
| 2008/0101940 | A1 | 5/2008 | LaMaster et al. |
| 2008/0101941 | A1 | 5/2008 | LaMaster et al. |
| 2008/0101942 | A1 | 5/2008 | McGowan et al. |
| 2008/0101943 | A1 | 5/2008 | Columbus et al. |
| 2008/0101944 | A1 | 5/2008 | Spracher et al. |
| 2008/0101945 | A1 | 5/2008 | Tomberg et al. |
| 2008/0101946 | A1 | 5/2008 | Duong et al. |
| 2008/0101947 | A1 | 5/2008 | Shrum et al. |
| 2008/0101948 | A1 | 5/2008 | Latimer et al. |
| 2008/0101949 | A1 | 5/2008 | Spracher et al. |
| 2008/0101950 | A1 | 5/2008 | Noshi et al. |
| 2008/0101951 | A1 | 5/2008 | Hudson et al. |
| 2008/0101952 | A1 | 5/2008 | Duong et al. |
| 2008/0101953 | A1 | 5/2008 | Huskins et al. |
| 2008/0101954 | A1 | 5/2008 | Latimer et al. |
| 2008/0101955 | A1 | 5/2008 | McGowan et al. |
| 2008/0101956 | A1 | 5/2008 | Douchkin et al. |
| 2008/0101957 | A1 | 5/2008 | Columbus et al. |
| 2008/0101958 | A1 | 5/2008 | Latimer et al. |
| 2008/0107534 | A1 | 5/2008 | Cheruku et al. |
| 2008/0107535 | A1 | 5/2008 | Radhakrishnan et al. |
| 2008/0107536 | A1 | 5/2008 | Devangada et al. |
| 2008/0141921 | A1 | 6/2008 | Hinderks |
| 2008/0178994 | A1 | 7/2008 | Qi et al. |
| 2008/0260516 | A1 | 10/2008 | Micheli |
| 2009/0031591 | A1 | 2/2009 | Shreider et al. |
| 2009/0035122 | A1 | 2/2009 | Yagi et al. |
| 2009/0180939 | A1 | 7/2009 | Hagen et al. |
| 2010/0061850 | A1 | 3/2010 | Hudson et al. |
| 2010/0061862 | A1 | 3/2010 | Bonini et al. |
| 2010/0068048 | A1 | 3/2010 | Spracher et al. |
| 2010/0092283 | A1 | 4/2010 | Hudson et al. |
| 2010/0092284 | A1 | 4/2010 | Bonini et al. |
| 2010/0092298 | A1 | 4/2010 | Hudson et al. |
| 2013/0336777 | A1 | 12/2013 | McKeever et al. |
| 2013/0336778 | A1 | 12/2013 | Dutka et al. |
| 2013/0336779 | A1 | 12/2013 | McKeever et al. |
| 2013/0336780 | A1 | 12/2013 | McKeever et al. |
| 2013/0336798 | A1 | 12/2013 | Dutka et al. |

FOREIGN PATENT DOCUMENTS

| | | | |
|---|---|---|---|
| EP | 1916386 | A2 | 4/2008 |
| EP | 1916387 | A2 | 4/2008 |
| EP | 1918513 | A2 | 5/2008 |
| EP | 1918514 | A2 | 5/2008 |
| EP | 1918515 | A2 | 5/2008 |
| EP | 1918516 | A2 | 5/2008 |
| EP | 1918517 | A2 | 5/2008 |
| EP | 1918518 | A2 | 5/2008 |
| EP | 1918519 | A2 | 5/2008 |
| EP | 1918590 | A2 | 5/2008 |
| EP | 1921257 | A2 | 5/2008 |
| EP | 1921258 | A2 | 5/2008 |
| EP | 1921259 | A2 | 5/2008 |
| EP | 1921260 | A2 | 5/2008 |
| EP | 1921261 | A2 | 5/2008 |
| EP | 1921262 | A2 | 5/2008 |
| EP | 1921263 | A2 | 5/2008 |
| EP | 1921264 | A2 | 5/2008 |
| EP | 1921265 | A2 | 5/2008 |
| EP | 1921266 | A2 | 5/2008 |
| EP | 1921267 | A2 | 5/2008 |
| EP | 1970534 | A2 | 9/2008 |
| EP | 2020509 | A2 | 2/2009 |
| EP | 1495819 | B1 | 3/2009 |
| EP | 1741935 | B1 | 1/2010 |
| WO | 2008/045036 | A2 | 4/2008 |
| WO | 2008/094058 | A2 | 8/2008 |
| WO | 2009/145745 | A1 | 12/2009 |

* cited by examiner

AIRFOIL SHAPE FOR A COMPRESSOR

RELATED APPLICATIONS

The present application is related to the following commonly assigned applications: Ser. No. 14/845,337; Ser. No. 14/845,347; Ser. No. 14/845,358; Ser. No. 14/845,347; Ser. No. 14/845,360; Ser. No. 14/845,378; Ser. No. 14/845,388; Ser. No. 14/845,398; Ser. No. 14/845,411; Ser. No. 14/845,421, filed concurrently herewith.

TECHNICAL FIELD

The present application and the resultant patent relate generally to gas turbine engines and more particularly relates to an airfoil profile or airfoil shape for use in a compressor.

BACKGROUND OF THE INVENTION

In a gas turbine engine, many system requirements should be met at each stage of the flow path therethrough to meet design goals. These design goals include, but are not limited to, overall improved efficiency, a reduction in vibratory response, improved airfoil loading capability, and the like. For example, a compressor airfoil profile should achieve thermal and mechanical operating requirements for a particular stage in the compressor. Moreover, component lifetime, reliability, and cost targets also should be met.

SUMMARY OF THE INVENTION

According to one aspect of the present application, an article of manufacture is provided with a nominal airfoil profile substantially in accordance with the Cartesian coordinate values of X, Y, and Z set forth in scalable TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete airfoil shape.

According to another aspect of the present application, an article of manufacture is provided with a suction-side nominal airfoil profile substantially in accordance with the suction-side Cartesian coordinate values of X, Y, and Z set forth in scalable TABLE 1, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined smoothly with one another to form a complete suction-side airfoil shape, the X, Y, and Z coordinate values being scalable as a function of the number to provide at least one of a non-scaled, scaled-up, and scaled-down airfoil profile.

According to yet another aspect of the present application, a compressor is provided with a number of rotor blades, each of the rotor blades including an airfoil having a suction-side airfoil shape, the airfoil having a nominal profile substantially in accordance with the suction-side Cartesian coordinate values of X, Y, and Z set forth in scalable TABLE 1, wherein the Cartesian coordinate values of X, Y and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete suction-side airfoil shape.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
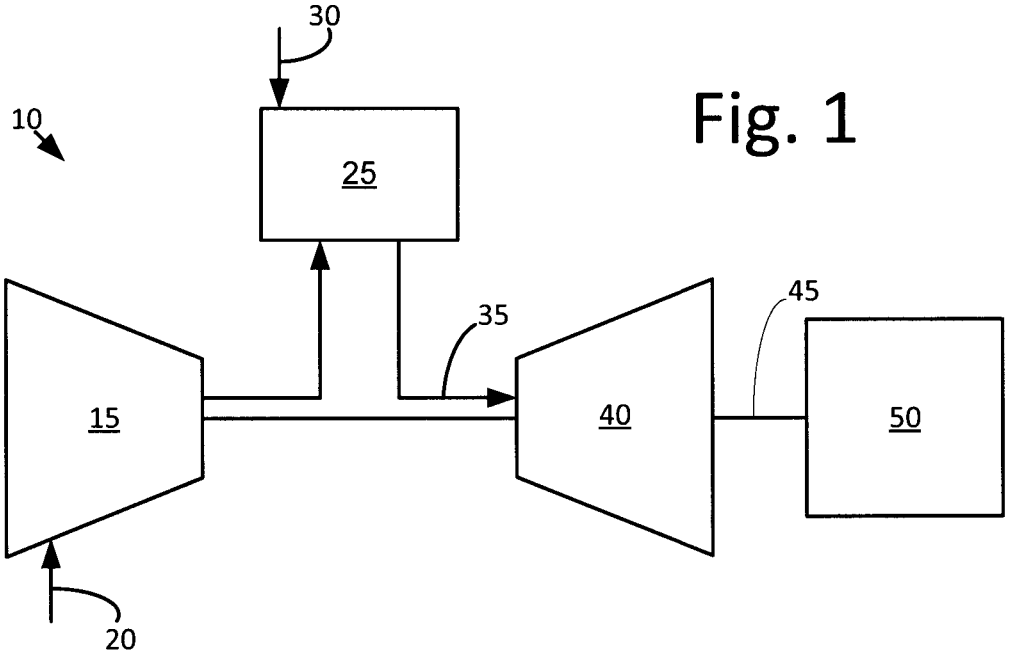
FIG. 1 is a schematic diagram of a gas turbine engine including a compressor, a combustor, a turbine, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of the combustors 25 arranged in a circumferential array or otherwise. The flow of combustion gases 35 is delivered in turn to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuels, various types of syngas, and/or other types of fuels and blends thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
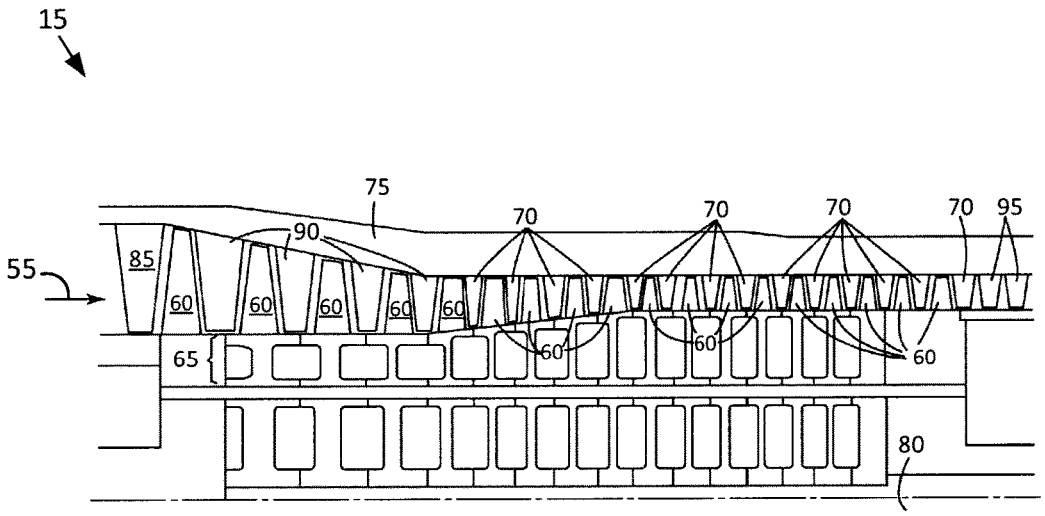
FIG. 2 is a schematic diagram of a compressor with multiple stages and a flow path therethrough.

FIG. 2 shows an example of the compressor 15. The compressor 15 may include a number of compressor stages with an axial compressor flow path 55 therethrough. As one non-limiting example only, the compressor flow path 55 may include about eighteen rotor/stator stages. The exact number of rotor and stator stages, however, may be a matter of engineering design choice and may be more or less than the illustrated eighteen stages. It is to be understood that any number of rotor and stator stages may be provided herein.

Each stage of the compressor 15 may include a number of circumferentially spaced rotor blades 60 mounted on a rotor wheel 65 and a number of circumferentially spaced stator vanes 70 attached to a static compressor case 75. Each of the rotor wheels 65 may be attached to an aft drive shaft 80, which may be connected to the turbine section of the engine. The rotor blades and stator vanes may lie in the flow path 55 of the compressor 15. The direction of airflow through the compressor flow path 55 flows generally from left to right in FIG. 2. Other components and other configurations may be used herein.

The compressor rotor blades 60 impart kinetic energy to the airflow and therefore bring about a desired pressure rise. Directly following the rotor blades 60 may be a stage of the compressor stator vanes 70. However, in some designs the stator vanes may precede the rotor blades. Both the rotor blades and stator vanes turn the airflow, slow the airflow velocity (in the respective airfoil frame of reference), and yield a rise in the static pressure of the airflow. Typically, multiple rows of rotor/stator stages are arranged in axial flow compressors to achieve a desired discharge to inlet pressure ratio. Each rotor blade and stator vane includes an airfoil, and these airfoils can be secured to rotor wheels or a stator case by an appropriate attachment configuration, often known as a "root," "base" or "dovetail". In addition, the compressor 15 also may include inlet guide vanes (IGV's) 85, variable stator vanes (VSV's) 90, and exit or exhaust guide vanes (EGV's) 95. All of these blades and vanes have airfoils that act on the medium (e.g., air) passing through the compressor flow path 55. Other components and other configurations may be used herein.

The rotor blades 60 and stator vanes 70 are merely exemplary of the stages of the compressor 15 described herein. In addition, each rotor blade 60, stator vane 70, inlet guide vane 85, variable stator vane 90, and exit guide vane 95 may be considered an article of manufacture. Further, the article of manufacture may include a rotor blade configured for use with a compressor 15.

Figure 3:
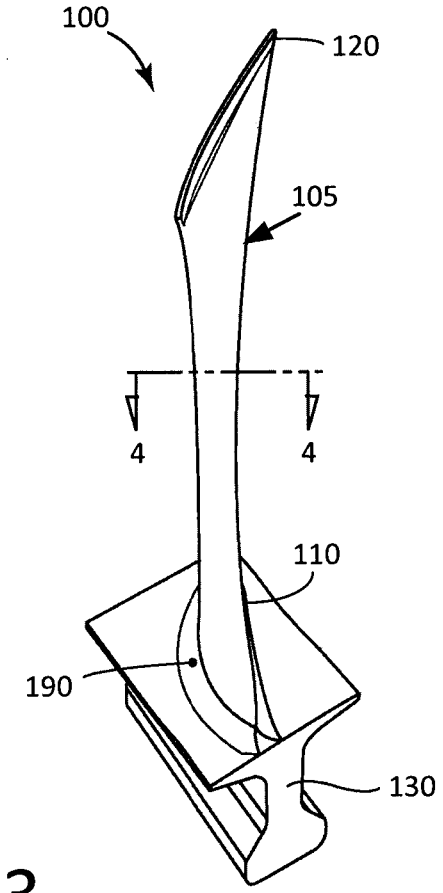
FIG. 3 is a perspective view of a rotor blade airfoil as may be described herein.

FIG. 3 shows an example of a rotor blade 100 as may be described herein. In this example, the rotor blade 100 includes an airfoil 105. Each of the rotor blades 100 may have an airfoil profile at any cross-section from an airfoil root 110 to an airfoil tip 120. The airfoil 105 may connect to a mounting base 130, which also may be referred to as a dovetail. The mounting base 130 fits into a complementary shaped groove or slot in the rotor or rotor wheel 65. Examples of the compressor 15 may include a variety of blades 60 and vanes 70, 85, 90, 95 arranged in multiple stages.

Figure 4:
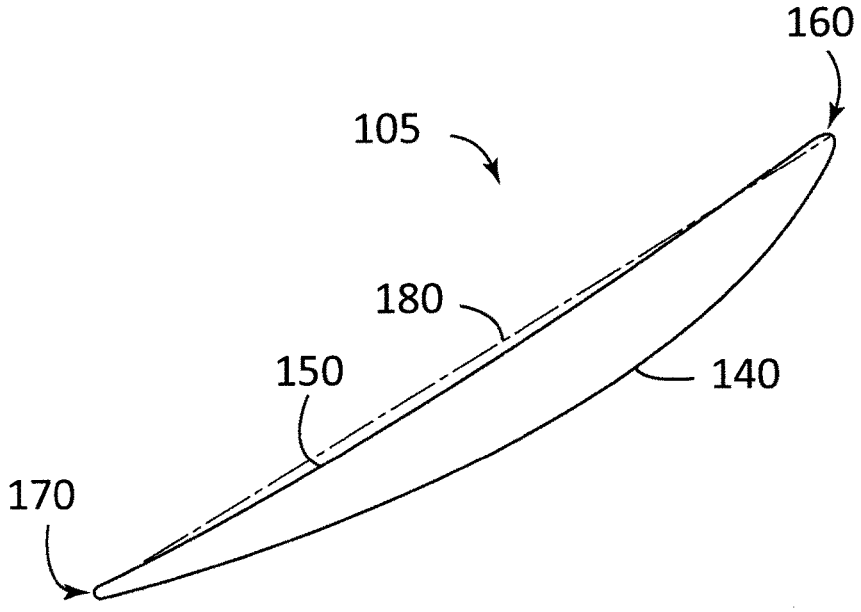
FIG. 4 is a cross-sectional view of the rotor blade airfoil taken along line 4-4 of FIG. 3.

Referring to FIG. 4, the airfoil 105 may have a suction side 140 and a pressure side 150. The suction side 140 may be located on the opposing side of the airfoil 105 from the pressure side 150. Thus, each rotor blade 60 may have an airfoil profile at any cross-section in the shape of the airfoil 105. The airfoil 105 also may include a leading edge 160 and a trailing edge 170 and with a chord length 180 extending therebetween. The root 110 of the airfoil 105 corresponds to the lowest non-dimensional Z value of scalable TABLE 1. The tip 120 of the airfoil 105 corresponds to the highest non-dimensional Z value of scalable TABLE 1. An airfoil 105 may extend beyond the compressor flowpath and may be tipped to achieve the desired endwall clearances. By way of example only, the airfoil may have a height from about one (1) inch to about twenty (20) inches (about 2.54 centimeters to about 50.8 centimeters) or more. Any specific airfoil height may be used herein as desired in a specific application. Other components and other configurations may be used herein.

The compressor flow path 55 requires airfoils 105 that meet system requirements of aerodynamic and mechanical blade/vane loading and efficiency. For example, it is desirable that the airfoils 105 are designed to reduce the vibratory response or vibratory stress response of the respective blades and/or vanes. Materials such as high strength alloys, non-corrosive alloys, and/or stainless steels may be used in the blades and/or vanes. To define the airfoil shape of each blade airfoil and/or vane airfoil, there is a unique set or loci of points in space that meet the stage requirements and can be manufactured. These unique loci of points meet the requirements for stage efficiency and may be arrived at by iteration between aerodynamic and mechanical loadings so as to enable the turbine and compressor to run in an efficient, safe, reliable, and smooth manner. These points are unique and specific to the system. The locus that defines the airfoil profile includes a set of points with X, Y, and Z coordinates relative to a reference origin coordinate system. The three-dimensional Cartesian coordinate system of X, Y, and Z values given in scalable TABLE 1 below defines the profile of the rotor blade airfoil at various locations along its length. The scalable TABLE 1 lists data for a non-coated airfoil. The envelope/tolerance for the coordinates may be about +/−5% of the chord length 180 in a direction normal to any airfoil surface location or about +/−0.25 inches (about 6.36 millimeters) in a direction normal to any airfoil surface location. However, tolerances of about +/−0.15 inches to about +/−0.25 inches (about 6.36 millimeters), or about +/−3% to about +/−5% in a direction normal to an airfoil surface location may also be used, as desired in the specific application.

A point data origin 190 may be the mid-point of the suction or pressure side of the base or tip of the airfoil, the leading edge or trailing edge of the base of the airfoil, or any other suitable location as desired. The coordinate values for the X, Y, and Z coordinates are set forth in non-dimensionalized units in scalable TABLE 1, although other units of dimensions may be used when the values are appropriately converted. As one example only, the Cartesian coordinate values of X, Y, and Z may be convertible to dimensional distances by multiplying the X, Y, and Z values by a constant number (e.g., 100). The number, used to convert the non-dimensional values to dimensional distances, may be a fraction (e.g., ½, ¼, etc.), decimal fraction (e.g., 0.5, 1.5, 10.25, etc.), integer (e.g., 1, 2, 10, 100, etc.), a mixed number (e.g., 11/2, 101/4, etc.), and the like. The dimensional distances may be in any suitable format (e.g., inches, feet, millimeters, centimeters, meters, etc.) As one non-limiting example only, the Cartesian coordinate system has orthogonally-related X, Y, and Z axes and the X axis may lie generally parallel to the compressor rotor centerline, i.e., the rotary axis and a positive X coordinate value is axial toward the aft, i.e., exhaust end of the turbine. The positive Y coordinate value extends tangentially in the direction of rotation of the rotor and the positive Z coordinate value is radially outwardly toward the rotor blade tip or stator vane base. All the values in scalable TABLE 1 are given at room temperature and are unfilleted.

By defining X and Y coordinate values at selected locations in a Z direction (or height) normal to the X, Y plane, the profile section or airfoil shape of the airfoil, at each Z height along the length of the airfoil may be ascertained. By connecting the X and Y values with smooth continuing arcs, each profile section at each Z height may be fixed. The airfoil profiles of the various surface locations between each Z height may be determined by smoothly connecting the adjacent profile sections to one another to form the airfoil profile.

The values in TABLE 1 may be generated and shown from zero to four or more decimal places for determining the profile of the airfoil. As the airfoil heats up the associated stress and temperature may cause a change in the X, Y, and Z values. Accordingly, the values for the profile given in TABLE 1 represent ambient, non-operating or non-hot conditions (e.g., room temperature) and may be for an uncoated airfoil.

There are typical manufacturing tolerances as well as optional coatings which may be accounted for in the actual profile of the airfoil. Each section may be joined smoothly with the other sections to form the complete airfoil shape. It will therefore be appreciated that +/− typical manufacturing tolerances, i.e., +/− values, including any coating thicknesses, are additive to the X and Y values given in TABLE 1 below. Accordingly, a distance of about +/−5% of chord length and/or +/−0.25 inches (about 6.36 millimeters) in a direction normal to a surface location along the airfoil profile defines an airfoil profile envelope for this particular airfoil design and compressor, i.e., a range of variation between measured points on the actual airfoil surface at nominal cold or room temperature and the ideal position of those points as given in the TABLE 1 below at the same temperature. Additionally, a distance of about +/−5% of a chord length in a direction normal to an airfoil surface location along the airfoil profile also may define an airfoil profile envelope for this particular airfoil design. The data is scalable and the geometry pertains to all aerodynamic scales, at, above and/or below about 3,000 RPM. The rotor blade airfoil design is robust to this range of variation without impairment of mechanical and aerodynamic functions.

The coordinate values given in scalable TABLE 1 below provide the nominal profile for exemplary stages of a compressor rotor blade. Specifically, a fourth stage rotor blade of, for example, a 9HA.01 compressor and the like:

TABLE 1

| PRESSURE SIDE | | | SUCTION SIDE | | |
|---|---|---|---|---|---|
| X | Y | Z | X | Y | Z |
| −1.5286 | 2.1692 | −0.3397 | 2.5271 | −1.2104 | −0.3397 |
| −1.5276 | 2.1695 | −0.3397 | 2.5248 | −1.2189 | −0.3397 |
| −1.5254 | 2.1701 | −0.3397 | 2.5194 | −1.2293 | −0.3397 |
| −1.5211 | 2.171 | −0.3397 | 2.5093 | −1.2398 | −0.3397 |
| −1.5123 | 2.1715 | −0.3397 | 2.4935 | −1.2472 | −0.3397 |
| −1.4988 | 2.1695 | −0.3397 | 2.47 | −1.2478 | −0.3397 |
| −1.4759 | 2.1602 | −0.3397 | 2.4393 | −1.2463 | −0.3397 |
| −1.4488 | 2.1416 | −0.3397 | 2.4009 | −1.2443 | −0.3397 |
| −1.4172 | 2.1118 | −0.3397 | 2.3543 | −1.2415 | −0.3397 |
| −1.3825 | 2.0702 | −0.3397 | 2.2988 | −1.2377 | −0.3397 |
| −1.342 | 2.0121 | −0.3397 | 2.234 | −1.2327 | −0.3397 |
| −1.2987 | 1.9429 | −0.3397 | 2.1575 | −1.2257 | −0.3397 |
| −1.2534 | 1.8686 | −0.3397 | 2.0694 | −1.2164 | −0.3397 |
| −1.2022 | 1.785 | −0.3397 | 1.9699 | −1.204 | −0.3397 |
| −1.145 | 1.6924 | −0.3397 | 1.8591 | −1.1881 | −0.3397 |
| −1.0811 | 1.5913 | −0.3397 | 1.7371 | −1.1678 | −0.3397 |
| −1.0125 | 1.4865 | −0.3397 | 1.6041 | −1.1422 | −0.3397 |
| −0.9391 | 1.3785 | −0.3397 | 1.4661 | −1.1116 | −0.3397 |
| −0.8604 | 1.2677 | −0.3397 | 1.323 | −1.0753 | −0.3397 |
| −0.776 | 1.1542 | −0.3397 | 1.1755 | −1.0328 | −0.3397 |
| −0.6857 | 1.0385 | −0.3397 | 1.0246 | −0.9837 | −0.3397 |
| −0.589 | 0.9208 | −0.3397 | 0.8707 | −0.9272 | −0.3397 |
| −0.486 | 0.802 | −0.3397 | 0.7142 | −0.8628 | −0.3397 |
| −0.3765 | 0.6825 | −0.3397 | 0.5553 | −0.7896 | −0.3397 |
| −0.264 | 0.5663 | −0.3397 | 0.3997 | −0.7097 | −0.3397 |
| −0.1486 | 0.4534 | −0.3397 | 0.2475 | −0.6226 | −0.3397 |
| −0.0301 | 0.3438 | −0.3397 | 0.0988 | −0.5279 | −0.3397 |
| 0.0913 | 0.2375 | −0.3397 | −0.0459 | −0.4251 | −0.3397 |
| 0.2152 | 0.1341 | −0.3397 | −0.185 | −0.3157 | −0.3397 |
| 0.3412 | 0.0329 | −0.3397 | −0.3182 | −0.2005 | −0.3397 |
| 0.4687 | −0.0666 | −0.3397 | −0.4459 | −0.0801 | −0.3397 |

TABLE 1-continued

| PRESSURE SIDE | | | SUCTION SIDE | | |
|---|---|---|---|---|---|
| X | Y | Z | X | Y | Z |
| 0.5975 | −0.1645 | −0.3397 | −0.5685 | 0.0454 | −0.3397 |
| 0.728 | −0.2607 | −0.3397 | −0.6857 | 0.176 | −0.3397 |
| 0.8605 | −0.3546 | −0.3397 | −0.7973 | 0.312 | −0.3397 |
| 0.9948 | −0.4458 | −0.3397 | −0.9031 | 0.4536 | −0.3397 |
| 1.1264 | −0.5308 | −0.3397 | −0.9998 | 0.5954 | −0.3397 |
| 1.2554 | −0.6099 | −0.3397 | −1.0871 | 0.7355 | −0.3397 |
| 1.3816 | −0.6831 | −0.3397 | −1.1656 | 0.8733 | −0.3397 |
| 1.5049 | −0.7505 | −0.3397 | −1.236 | 1.0084 | −0.3397 |
| 1.6252 | −0.8125 | −0.3397 | −1.2989 | 1.1405 | −0.3397 |
| 1.7422 | −0.8693 | −0.3397 | −1.3549 | 1.2694 | −0.3397 |
| 1.8554 | −0.9211 | −0.3397 | −1.4045 | 1.3948 | −0.3397 |
| 1.9598 | −0.9662 | −0.3397 | −1.4484 | 1.5164 | −0.3397 |
| 2.0551 | −1.005 | −0.3397 | −1.4851 | 1.6285 | −0.3397 |
| 2.141 | −1.0383 | −0.3397 | −1.5153 | 1.7306 | −0.3397 |
| 2.2172 | −1.0666 | −0.3397 | −1.5398 | 1.8223 | −0.3397 |
| 2.2836 | −1.0902 | −0.3397 | −1.5606 | 1.9088 | −0.3397 |
| 2.34 | −1.1095 | −0.3397 | −1.574 | 1.9847 | −0.3397 |
| 2.3883 | −1.1256 | −0.3397 | −1.5782 | 2.0437 | −0.3397 |
| 2.4291 | −1.1388 | −0.3397 | −1.575 | 2.091 | −0.3397 |
| 2.4626 | −1.1495 | −0.3397 | −1.5663 | 2.1255 | −0.3397 |
| 2.4896 | −1.1579 | −0.3397 | −1.5541 | 2.1493 | −0.3397 |
| 2.5094 | −1.1664 | −0.3397 | −1.5441 | 2.1603 | −0.3397 |
| 2.5207 | −1.1785 | −0.3397 | −1.5363 | 2.1658 | −0.3397 |
| 2.5262 | −1.1911 | −0.3397 | −1.532 | 2.1679 | −0.3397 |
| 2.5277 | −1.2021 | −0.3397 | −1.5298 | 2.1688 | −0.3397 |
| −1.5805 | 2.0774 | 0 | 2.5345 | −1.2191 | 0 |
| −1.5794 | 2.0778 | 0 | 2.5321 | −1.2274 | 0 |
| −1.5774 | 2.0785 | 0 | 2.5264 | −1.2374 | 0 |
| −1.5731 | 2.0796 | 0 | 2.5158 | −1.2472 | 0 |
| −1.5644 | 2.0805 | 0 | 2.4998 | −1.2535 | 0 |
| −1.5509 | 2.079 | 0 | 2.4766 | −1.2532 | 0 |
| −1.5279 | 2.0707 | 0 | 2.4464 | −1.2511 | 0 |
| −1.5003 | 2.0534 | 0 | 2.4087 | −1.2484 | 0 |
| −1.4678 | 2.0251 | 0 | 2.3629 | −1.2447 | 0 |
| −1.4315 | 1.9852 | 0 | 2.3084 | −1.2398 | 0 |
| −1.3889 | 1.9294 | 0 | 2.2448 | −1.2335 | 0 |
| −1.3428 | 1.8629 | 0 | 2.1696 | −1.2252 | 0 |
| −1.2942 | 1.7915 | 0 | 2.0831 | −1.2143 | 0 |
| −1.2395 | 1.7112 | 0 | 1.9854 | −1.2003 | 0 |
| −1.1783 | 1.6223 | 0 | 1.8767 | −1.1826 | 0 |
| −1.1101 | 1.5251 | 0 | 1.757 | −1.1604 | 0 |
| −1.0375 | 1.4244 | 0 | 1.6265 | −1.133 | 0 |
| −0.9601 | 1.3206 | 0 | 1.491 | −1.1008 | 0 |
| −0.8774 | 1.214 | 0 | 1.3507 | −1.0632 | 0 |
| −0.7892 | 1.1051 | 0 | 1.2061 | −1.0197 | 0 |
| −0.6954 | 0.9941 | 0 | 1.058 | −0.97 | 0 |
| −0.5955 | 0.8813 | 0 | 0.907 | −0.9135 | 0 |
| −0.4893 | 0.7669 | 0 | 0.7531 | −0.8496 | 0 |
| −0.3764 | 0.6512 | 0 | 0.5967 | −0.7778 | 0 |
| −0.2606 | 0.5382 | 0 | 0.4434 | −0.6998 | 0 |
| −0.1421 | 0.4281 | 0 | 0.2931 | −0.6156 | 0 |
| −0.0211 | 0.3212 | 0 | 0.1461 | −0.5245 | 0 |
| 0.1024 | 0.2174 | 0 | 0.0027 | −0.4263 | 0 |
| 0.228 | 0.1163 | 0 | −0.1369 | −0.321 | 0 |
| 0.3552 | 0.0172 | 0 | −0.2711 | −0.2103 | 0 |
| 0.4837 | −0.0804 | 0 | −0.4004 | −0.0947 | 0 |
| 0.6134 | −0.1765 | 0 | −0.5248 | 0.0253 | 0 |
| 0.7444 | −0.2709 | 0 | −0.6444 | 0.1499 | 0 |
| 0.877 | −0.3632 | 0 | −0.759 | 0.2792 | 0 |
| 1.0113 | −0.4529 | 0 | −0.8684 | 0.4135 | 0 |
| 1.1428 | −0.5369 | 0 | −0.9692 | 0.548 | 0 |
| 1.2714 | −0.6151 | 0 | −1.0618 | 0.6822 | 0 |
| 1.3971 | −0.6878 | 0 | −1.1464 | 0.8151 | 0 |
| 1.5198 | −0.755 | 0 | −1.2232 | 0.9458 | 0 |
| 1.6394 | −0.817 | 0 | −1.2927 | 1.074 | 0 |
| 1.7555 | −0.8739 | 0 | −1.3553 | 1.1993 | 0 |
| 1.8679 | −0.9261 | 0 | −1.4115 | 1.3212 | 0 |
| 1.9715 | −0.9716 | 0 | −1.4618 | 1.4394 | 0 |
| 2.066 | −1.0111 | 0 | −1.5045 | 1.548 | 0 |
| 2.1512 | −1.0449 | 0 | −1.5402 | 1.6469 | 0 |
| 2.2267 | −1.0738 | 0 | −1.5696 | 1.7355 | 0 |
| 2.2925 | −1.098 | 0 | −1.595 | 1.8194 | 0 |
| 2.3484 | −1.1178 | 0 | −1.6127 | 1.8931 | 0 |
| 2.3963 | −1.1344 | 0 | −1.6205 | 1.9509 | 0 |
| 2.4366 | −1.1481 | 0 | −1.6205 | 1.9975 | 0 |
| 2.4699 | −1.1591 | 0 | −1.6145 | 2.032 | 0 |

TABLE 1-continued

| PRESSURE SIDE | | | SUCTION SIDE | | |
|---|---|---|---|---|---|
| X | Y | Z | X | Y | Z |
| 2.4966 | −1.1677 | 0 | −1.6041 | 2.0562 | 0 |
| 2.5165 | −1.176 | 0 | −1.5951 | 2.0677 | 0 |
| 2.528 | −1.1876 | 0 | −1.5878 | 2.0736 | 0 |
| 2.5337 | −1.2 | 0 | −1.5837 | 2.076 | 0 |
| 2.5352 | −1.2108 | 0 | −1.5816 | 2.077 | 0 |
| −1.6593 | 1.9293 | 0.5648 | 2.546 | −1.2375 | 0.5648 |
| −1.6583 | 1.9298 | 0.5648 | 2.5433 | −1.2455 | 0.5648 |
| −1.6563 | 1.9307 | 0.5648 | 2.5373 | −1.2551 | 0.5648 |
| −1.6522 | 1.9321 | 0.5648 | 2.5265 | −1.2642 | 0.5648 |
| −1.6436 | 1.9337 | 0.5648 | 2.5104 | −1.2695 | 0.5648 |
| −1.6301 | 1.9332 | 0.5648 | 2.4877 | −1.2679 | 0.5648 |
| −1.6068 | 1.9264 | 0.5648 | 2.4583 | −1.2645 | 0.5648 |
| −1.5783 | 1.911 | 0.5648 | 2.4215 | −1.26 | 0.5648 |
| −1.5441 | 1.8852 | 0.5648 | 2.3769 | −1.2543 | 0.5648 |
| −1.5052 | 1.8483 | 0.5648 | 2.3238 | −1.247 | 0.5648 |
| −1.4587 | 1.7963 | 0.5648 | 2.2618 | −1.238 | 0.5648 |
| −1.4077 | 1.7342 | 0.5648 | 2.1886 | −1.2266 | 0.5648 |
| −1.3538 | 1.6675 | 0.5648 | 2.1044 | −1.2126 | 0.5648 |
| −1.2931 | 1.5925 | 0.5648 | 2.0092 | −1.1953 | 0.5648 |
| −1.2254 | 1.5094 | 0.5648 | 1.9032 | −1.1741 | 0.5648 |
| −1.1502 | 1.4186 | 0.5648 | 1.7866 | −1.1486 | 0.5648 |
| −1.0707 | 1.3244 | 0.5648 | 1.6595 | −1.118 | 0.5648 |
| −0.9864 | 1.2272 | 0.5648 | 1.5276 | −1.083 | 0.5648 |
| −0.8972 | 1.1273 | 0.5648 | 1.3909 | −1.0433 | 0.5648 |
| −0.8027 | 1.025 | 0.5648 | 1.25 | −0.9983 | 0.5648 |
| −0.7028 | 0.9206 | 0.5648 | 1.1056 | −0.9478 | 0.5648 |
| −0.5973 | 0.8142 | 0.5648 | 0.9579 | −0.8913 | 0.5648 |
| −0.4859 | 0.7061 | 0.5648 | 0.8073 | −0.8283 | 0.5648 |
| −0.3684 | 0.5966 | 0.5648 | 0.6541 | −0.7582 | 0.5648 |
| −0.2487 | 0.4893 | 0.5648 | 0.5035 | −0.6829 | 0.5648 |
| −0.1271 | 0.3846 | 0.5648 | 0.3557 | −0.6022 | 0.5648 |
| −0.0034 | 0.2825 | 0.5648 | 0.2108 | −0.5157 | 0.5648 |
| 0.1221 | 0.183 | 0.5648 | 0.069 | −0.4232 | 0.5648 |
| 0.2493 | 0.0856 | 0.5648 | −0.0696 | −0.3245 | 0.5648 |
| 0.3776 | −0.0104 | 0.5648 | −0.2052 | −0.2198 | 0.5648 |
| 0.5068 | −0.1051 | 0.5648 | −0.3367 | −0.1106 | 0.5648 |
| 0.6369 | −0.1985 | 0.5648 | −0.4641 | 0.0025 | 0.5648 |
| 0.7683 | −0.2904 | 0.5648 | −0.5874 | 0.1192 | 0.5648 |
| 0.9011 | −0.3803 | 0.5648 | −0.7066 | 0.2398 | 0.5648 |
| 1.0356 | −0.468 | 0.5648 | −0.8215 | 0.3644 | 0.5648 |
| 1.1672 | −0.5502 | 0.5648 | −0.9284 | 0.4886 | 0.5648 |
| 1.2957 | −0.6271 | 0.5648 | −1.0277 | 0.6121 | 0.5648 |
| 1.421 | −0.6987 | 0.5648 | −1.1198 | 0.7346 | 0.5648 |
| 1.5431 | −0.7653 | 0.5648 | −1.205 | 0.8557 | 0.5648 |
| 1.6617 | −0.827 | 0.5648 | −1.2837 | 0.9752 | 0.5648 |
| 1.7769 | −0.8841 | 0.5648 | −1.3558 | 1.092 | 0.5648 |
| 1.8882 | −0.9366 | 0.5648 | −1.4216 | 1.206 | 0.5648 |
| 1.9907 | −0.9828 | 0.5648 | −1.4814 | 1.3169 | 0.5648 |
| 2.0841 | −1.0231 | 0.5648 | −1.533 | 1.419 | 0.5648 |
| 2.1682 | −1.058 | 0.5648 | −1.5771 | 1.5122 | 0.5648 |
| 2.2428 | −1.0879 | 0.5648 | −1.614 | 1.596 | 0.5648 |
| 2.3077 | −1.113 | 0.5648 | −1.6464 | 1.6755 | 0.5648 |
| 2.3629 | −1.1336 | 0.5648 | −1.6706 | 1.7459 | 0.5648 |
| 2.4101 | −1.151 | 0.5648 | −1.6839 | 1.8015 | 0.5648 |
| 2.45 | −1.1653 | 0.5648 | −1.6888 | 1.8469 | 0.5648 |
| 2.4828 | −1.1769 | 0.5648 | −1.6869 | 1.8813 | 0.5648 |
| 2.509 | −1.1862 | 0.5648 | −1.6798 | 1.906 | 0.5648 |
| 2.5288 | −1.1944 | 0.5648 | −1.6724 | 1.9183 | 0.5648 |
| 2.5402 | −1.206 | 0.5648 | −1.666 | 1.9249 | 0.5648 |
| 2.5457 | −1.2185 | 0.5648 | −1.6623 | 1.9276 | 0.5648 |
| 2.5469 | −1.2293 | 0.5648 | −1.6603 | 1.9288 | 0.5648 |
| −1.6919 | 1.8443 | 0.942 | 2.5479 | −1.2716 | 0.942 |
| −1.6909 | 1.8449 | 0.942 | 2.5449 | −1.2794 | 0.942 |
| −1.689 | 1.8459 | 0.942 | 2.5386 | −1.2887 | 0.942 |
| −1.685 | 1.8475 | 0.942 | 2.5276 | −1.2972 | 0.942 |
| −1.6765 | 1.8496 | 0.942 | 2.5115 | −1.3018 | 0.942 |
| −1.6631 | 1.8497 | 0.942 | 2.4891 | −1.2993 | 0.942 |
| −1.6395 | 1.8441 | 0.942 | 2.4602 | −1.2948 | 0.942 |
| −1.6104 | 1.8302 | 0.942 | 2.424 | −1.289 | 0.942 |
| −1.5752 | 1.8061 | 0.942 | 2.3801 | −1.2816 | 0.942 |
| −1.5347 | 1.771 | 0.942 | 2.328 | −1.2725 | 0.942 |
| −1.486 | 1.7214 | 0.942 | 2.267 | −1.2613 | 0.942 |
| −1.4324 | 1.6619 | 0.942 | 2.1951 | −1.2476 | 0.942 |
| −1.3757 | 1.598 | 0.942 | 2.1122 | −1.2309 | 0.942 |
| −1.312 | 1.526 | 0.942 | 2.0187 | −1.2109 | 0.942 |
| −1.241 | 1.4462 | 0.942 | 1.9145 | −1.1871 | 0.942 |

TABLE 1-continued

| PRESSURE SIDE | | | SUCTION SIDE | | |
|---|---|---|---|---|---|
| X | Y | Z | X | Y | Z |
| −1.1623 | 1.3588 | 0.942 | 1.7998 | −1.1587 | 0.942 |
| −1.0794 | 1.2682 | 0.942 | 1.6748 | −1.1254 | 0.942 |
| −0.9919 | 1.1745 | 0.942 | 1.545 | −1.088 | 0.942 |
| −0.8995 | 1.0781 | 0.942 | 1.4106 | −1.0462 | 0.942 |
| −0.8022 | 0.9792 | 0.942 | 1.272 | −0.9995 | 0.942 |
| −0.6996 | 0.878 | 0.942 | 1.1298 | −0.9477 | 0.942 |
| −0.5916 | 0.7747 | 0.942 | 0.9841 | −0.8904 | 0.942 |
| −0.478 | 0.6695 | 0.942 | 0.8352 | −0.8269 | 0.942 |
| −0.3585 | 0.5628 | 0.942 | 0.6835 | −0.7569 | 0.942 |
| −0.2373 | 0.4582 | 0.942 | 0.5341 | −0.6821 | 0.942 |
| −0.1144 | 0.3558 | 0.942 | 0.3872 | −0.6024 | 0.942 |
| 0.0104 | 0.2558 | 0.942 | 0.243 | −0.5175 | 0.942 |
| 0.1367 | 0.158 | 0.942 | 0.1016 | −0.427 | 0.942 |
| 0.2644 | 0.062 | 0.942 | −0.037 | −0.3307 | 0.942 |
| 0.393 | −0.0328 | 0.942 | −0.1725 | −0.2291 | 0.942 |
| 0.5224 | −0.1265 | 0.942 | −0.3042 | −0.1233 | 0.942 |
| 0.6526 | −0.2192 | 0.942 | −0.4322 | −0.014 | 0.942 |
| 0.7839 | −0.3103 | 0.942 | −0.5566 | 0.0987 | 0.942 |
| 0.9166 | −0.3997 | 0.942 | −0.6774 | 0.2149 | 0.942 |
| 1.0508 | −0.487 | 0.942 | −0.7944 | 0.3347 | 0.942 |
| 1.182 | −0.5691 | 0.942 | −0.9039 | 0.4541 | 0.942 |
| 1.3099 | −0.646 | 0.942 | −1.0062 | 0.5726 | 0.942 |
| 1.4345 | −0.718 | 0.942 | −1.1016 | 0.6899 | 0.942 |
| 1.5558 | −0.7851 | 0.942 | −1.1905 | 0.8058 | 0.942 |
| 1.6736 | −0.8476 | 0.942 | −1.2731 | 0.9201 | 0.942 |
| 1.7878 | −0.9057 | 0.942 | −1.3496 | 1.0322 | 0.942 |
| 1.8981 | −0.9595 | 0.942 | −1.4199 | 1.1417 | 0.942 |
| 1.9997 | −1.0069 | 0.942 | −1.4843 | 1.2483 | 0.942 |
| 2.0921 | −1.0487 | 0.942 | −1.5402 | 1.3467 | 0.942 |
| 2.1753 | −1.085 | 0.942 | −1.5883 | 1.4365 | 0.942 |
| 2.249 | −1.1161 | 0.942 | −1.6291 | 1.5174 | 0.942 |
| 2.3133 | −1.1424 | 0.942 | −1.6651 | 1.5943 | 0.942 |
| 2.3678 | −1.1642 | 0.942 | −1.6925 | 1.6625 | 0.942 |
| 2.4146 | −1.1825 | 0.942 | −1.7087 | 1.7167 | 0.942 |
| 2.4539 | −1.1977 | 0.942 | −1.7161 | 1.7612 | 0.942 |
| 2.4863 | −1.21 | 0.942 | −1.7161 | 1.7952 | 0.942 |
| 2.5123 | −1.2199 | 0.942 | −1.7107 | 1.8201 | 0.942 |
| 2.5318 | −1.2284 | 0.942 | −1.7042 | 1.8327 | 0.942 |
| 2.543 | −1.2402 | 0.942 | −1.6982 | 1.8396 | 0.942 |
| 2.5481 | −1.2527 | 0.942 | −1.6947 | 1.8425 | 0.942 |
| 2.5491 | −1.2634 | 0.942 | −1.6928 | 1.8437 | 0.942 |
| −1.7033 | 1.7801 | 1.3193 | 2.5396 | −1.3363 | 1.3193 |
| −1.7024 | 1.7807 | 1.3193 | 2.5364 | −1.344 | 1.3193 |
| −1.7005 | 1.7818 | 1.3193 | 2.5297 | −1.3529 | 1.3193 |
| −1.6966 | 1.7836 | 1.3193 | 2.5183 | −1.3608 | 1.3193 |
| −1.6883 | 1.7859 | 1.3193 | 2.5021 | −1.3644 | 1.3193 |
| −1.6748 | 1.7866 | 1.3193 | 2.4801 | −1.3608 | 1.3193 |
| −1.6511 | 1.7818 | 1.3193 | 2.4516 | −1.355 | 1.3193 |
| −1.6216 | 1.7689 | 1.3193 | 2.416 | −1.3476 | 1.3193 |
| −1.5857 | 1.7461 | 1.3193 | 2.3728 | −1.3383 | 1.3193 |
| −1.5442 | 1.7123 | 1.3193 | 2.3215 | −1.3269 | 1.3193 |
| −1.4942 | 1.6642 | 1.3193 | 2.2616 | −1.3132 | 1.3193 |
| −1.4389 | 1.6065 | 1.3193 | 2.1909 | −1.2966 | 1.3193 |
| −1.3804 | 1.5444 | 1.3193 | 2.1094 | −1.2766 | 1.3193 |
| −1.3146 | 1.4745 | 1.3193 | 2.0175 | −1.2531 | 1.3193 |
| −1.2414 | 1.3969 | 1.3193 | 1.915 | −1.2255 | 1.3193 |
| −1.1606 | 1.3118 | 1.3193 | 1.8022 | −1.1934 | 1.3193 |
| −1.0756 | 1.2234 | 1.3193 | 1.6793 | −1.1562 | 1.3193 |
| −0.986 | 1.132 | 1.3193 | 1.5517 | −1.1152 | 1.3193 |
| −0.8918 | 1.0376 | 1.3193 | 1.4195 | −1.0699 | 1.3193 |
| −0.7928 | 0.9407 | 1.3193 | 1.2832 | −1.0202 | 1.3193 |
| −0.6887 | 0.8413 | 1.3193 | 1.1431 | −0.9657 | 1.3193 |
| −0.5793 | 0.7398 | 1.3193 | 0.9994 | −0.906 | 1.3193 |
| −0.4645 | 0.6362 | 1.3193 | 0.8523 | −0.8407 | 1.3193 |
| −0.3441 | 0.5309 | 1.3193 | 0.7022 | −0.7691 | 1.3193 |
| −0.2221 | 0.4276 | 1.3193 | 0.5542 | −0.6933 | 1.3193 |
| −0.0986 | 0.3263 | 1.3193 | 0.4084 | −0.6131 | 1.3193 |
| 0.0265 | 0.2271 | 1.3193 | 0.265 | −0.5281 | 1.3193 |
| 0.153 | 0.1298 | 1.3193 | 0.1242 | −0.4379 | 1.3193 |
| 0.2807 | 0.034 | 1.3193 | −0.0138 | −0.3424 | 1.3193 |
| 0.4091 | −0.0608 | 1.3193 | −0.1486 | −0.2422 | 1.3193 |
| 0.5381 | −0.1547 | 1.3193 | −0.2795 | −0.1384 | 1.3193 |
| 0.6679 | −0.2478 | 1.3193 | −0.4072 | −0.0313 | 1.3193 |
| 0.7986 | −0.3395 | 1.3193 | −0.5316 | 0.079 | 1.3193 |
| 0.9305 | −0.4297 | 1.3193 | −0.6527 | 0.1925 | 1.3193 |
| 1.0638 | −0.518 | 1.3193 | −0.7705 | 0.3093 | 1.3193 |

TABLE 1-continued

| PRESSURE SIDE | | | SUCTION SIDE | | |
|---|---|---|---|---|---|
| X | Y | Z | X | Y | Z |
| 1.1938 | −0.6014 | 1.3193 | −0.8811 | 0.4255 | 1.3193 |
| 1.3205 | −0.68 | 1.3193 | −0.9848 | 0.5407 | 1.3193 |
| 1.4438 | −0.7538 | 1.3193 | −1.0819 | 0.6546 | 1.3193 |
| 1.5637 | −0.8231 | 1.3193 | −1.1727 | 0.767 | 1.3193 |
| 1.6801 | −0.8878 | 1.3193 | −1.2574 | 0.8776 | 1.3193 |
| 1.7928 | −0.9484 | 1.3193 | −1.3363 | 0.9863 | 1.3193 |
| 1.9016 | −1.0048 | 1.3193 | −1.4094 | 1.0927 | 1.3193 |
| 2.0017 | −1.0549 | 1.3193 | −1.4766 | 1.1962 | 1.3193 |
| 2.0927 | −1.0992 | 1.3193 | −1.5354 | 1.2919 | 1.3193 |
| 2.1746 | −1.1379 | 1.3193 | −1.5861 | 1.3793 | 1.3193 |
| 2.2473 | −1.1714 | 1.3193 | −1.6293 | 1.4581 | 1.3193 |
| 2.3105 | −1.1998 | 1.3193 | −1.6676 | 1.5331 | 1.3193 |
| 2.3642 | −1.2234 | 1.3193 | −1.6972 | 1.5998 | 1.3193 |
| 2.4102 | −1.2432 | 1.3193 | −1.715 | 1.6529 | 1.3193 |
| 2.4489 | −1.2598 | 1.3193 | −1.724 | 1.6968 | 1.3193 |
| 2.4808 | −1.2733 | 1.3193 | −1.7254 | 1.7305 | 1.3193 |
| 2.5064 | −1.284 | 1.3193 | −1.721 | 1.7553 | 1.3193 |
| 2.5256 | −1.2933 | 1.3193 | −1.7151 | 1.7681 | 1.3193 |
| 2.5361 | −1.3052 | 1.3193 | −1.7095 | 1.7751 | 1.3193 |
| 2.5407 | −1.3178 | 1.3193 | −1.7061 | 1.7782 | 1.3193 |
| 2.5412 | −1.3284 | 1.3193 | −1.7043 | 1.7795 | 1.3193 |
| −1.696 | 1.7435 | 1.6964 | 2.5184 | −1.4264 | 1.6964 |
| −1.6951 | 1.7441 | 1.6964 | 2.5148 | −1.4338 | 1.6964 |
| −1.6932 | 1.7452 | 1.6964 | 2.5077 | −1.4423 | 1.6964 |
| −1.6893 | 1.7471 | 1.6964 | 2.496 | −1.4495 | 1.6964 |
| −1.681 | 1.7495 | 1.6964 | 2.4797 | −1.4521 | 1.6964 |
| −1.6675 | 1.7503 | 1.6964 | 2.4581 | −1.4472 | 1.6964 |
| −1.6437 | 1.7456 | 1.6964 | 2.4301 | −1.44 | 1.6964 |
| −1.6141 | 1.7329 | 1.6964 | 2.3952 | −1.4308 | 1.6964 |
| −1.578 | 1.7103 | 1.6964 | 2.3528 | −1.4194 | 1.6964 |
| −1.5362 | 1.6769 | 1.6964 | 2.3025 | −1.4055 | 1.6964 |
| −1.4857 | 1.6294 | 1.6964 | 2.2437 | −1.389 | 1.6964 |
| −1.4298 | 1.5722 | 1.6964 | 2.1743 | −1.369 | 1.6964 |
| −1.3706 | 1.5107 | 1.6964 | 2.0944 | −1.3454 | 1.6964 |
| −1.3041 | 1.4415 | 1.6964 | 2.0042 | −1.3178 | 1.6964 |
| −1.2302 | 1.3647 | 1.6964 | 1.9037 | −1.2858 | 1.6964 |
| −1.1486 | 1.2804 | 1.6964 | 1.7931 | −1.2491 | 1.6964 |
| −1.0627 | 1.1928 | 1.6964 | 1.6725 | −1.2073 | 1.6964 |
| −0.9725 | 1.102 | 1.6964 | 1.5473 | −1.1616 | 1.6964 |
| −0.8777 | 1.0084 | 1.6964 | 1.4177 | −1.112 | 1.6964 |
| −0.7781 | 0.912 | 1.6964 | 1.284 | −1.0581 | 1.6964 |
| −0.6736 | 0.8131 | 1.6964 | 1.1466 | −0.9998 | 1.6964 |
| −0.5639 | 0.7118 | 1.6964 | 1.0057 | −0.9366 | 1.6964 |
| −0.4489 | 0.6085 | 1.6964 | 0.8615 | −0.8682 | 1.6964 |
| −0.3284 | 0.5033 | 1.6964 | 0.7143 | −0.7941 | 1.6964 |
| −0.2065 | 0.3999 | 1.6964 | 0.5691 | −0.7163 | 1.6964 |
| −0.0831 | 0.2984 | 1.6964 | 0.4262 | −0.6348 | 1.6964 |
| 0.0417 | 0.1988 | 1.6964 | 0.2857 | −0.5492 | 1.6964 |
| 0.1678 | 0.1007 | 1.6964 | 0.1479 | −0.459 | 1.6964 |
| 0.2948 | 0.0039 | 1.6964 | 0.0127 | −0.3643 | 1.6964 |
| 0.4224 | −0.0921 | 1.6964 | −0.1199 | −0.265 | 1.6964 |
| 0.5505 | −0.1876 | 1.6964 | −0.25 | −0.1616 | 1.6964 |
| 0.6791 | −0.2824 | 1.6964 | −0.3779 | −0.0544 | 1.6964 |
| 0.8085 | −0.3762 | 1.6964 | −0.5032 | 0.0562 | 1.6964 |
| 0.939 | −0.4685 | 1.6964 | −0.6256 | 0.1699 | 1.6964 |
| 1.0704 | −0.5593 | 1.6964 | −0.7447 | 0.2869 | 1.6964 |
| 1.1986 | −0.6455 | 1.6964 | −0.8569 | 0.4031 | 1.6964 |
| 1.3233 | −0.727 | 1.6964 | −0.9623 | 0.5183 | 1.6964 |
| 1.4447 | −0.8041 | 1.6964 | −1.061 | 0.6318 | 1.6964 |
| 1.5626 | −0.8767 | 1.6964 | −1.1532 | 0.7435 | 1.6964 |
| 1.677 | −0.945 | 1.6964 | −1.2393 | 0.8532 | 1.6964 |
| 1.7876 | −1.0092 | 1.6964 | −1.3192 | 0.9604 | 1.6964 |
| 1.8944 | −1.0693 | 1.6964 | −1.3932 | 1.0651 | 1.6964 |
| 1.9926 | −1.123 | 1.6964 | −1.4615 | 1.167 | 1.6964 |
| 2.0818 | −1.1707 | 1.6964 | −1.5213 | 1.2612 | 1.6964 |
| 2.1621 | −1.2127 | 1.6964 | −1.573 | 1.3472 | 1.6964 |
| 2.2333 | −1.2491 | 1.6964 | −1.6171 | 1.4248 | 1.6964 |
| 2.2953 | −1.2801 | 1.6964 | −1.6563 | 1.4986 | 1.6964 |
| 2.3479 | −1.306 | 1.6964 | −1.6866 | 1.5645 | 1.6964 |
| 2.3929 | −1.3279 | 1.6964 | −1.7052 | 1.617 | 1.6964 |
| 2.4308 | −1.3462 | 1.6964 | −1.7148 | 1.6604 | 1.6964 |
| 2.4621 | −1.3611 | 1.6964 | −1.7168 | 1.6939 | 1.6964 |
| 2.4871 | −1.373 | 1.6964 | −1.7129 | 1.7186 | 1.6964 |
| 2.506 | −1.3828 | 1.6964 | −1.7073 | 1.7314 | 1.6964 |
| 2.5162 | −1.3951 | 1.6964 | −1.7019 | 1.7385 | 1.6964 |
| 2.5203 | −1.4078 | 1.6964 | −1.6987 | 1.7415 | 1.6964 |

TABLE 1-continued

| PRESSURE SIDE | | | SUCTION SIDE | | |
|---|---|---|---|---|---|
| X | Y | Z | X | Y | Z |
| 2.5203 | −1.4185 | 1.6964 | −1.6969 | 1.7429 | 1.6964 |
| −1.6764 | 1.7282 | 2.0737 | 2.4842 | −1.5344 | 2.0737 |
| −1.6754 | 1.7288 | 2.0737 | 2.4802 | −1.5416 | 2.0737 |
| −1.6736 | 1.7299 | 2.0737 | 2.4726 | −1.5496 | 2.0737 |
| −1.6696 | 1.7318 | 2.0737 | 2.4605 | −1.556 | 2.0737 |
| −1.6613 | 1.7341 | 2.0737 | 2.4442 | −1.5574 | 2.0737 |
| −1.6478 | 1.7347 | 2.0737 | 2.4229 | −1.5511 | 2.0737 |
| −1.6241 | 1.7297 | 2.0737 | 2.3955 | −1.5422 | 2.0737 |
| −1.5946 | 1.7166 | 2.0737 | 2.3613 | −1.531 | 2.0737 |
| −1.5586 | 1.6936 | 2.0737 | 2.3198 | −1.5172 | 2.0737 |
| −1.5169 | 1.6599 | 2.0737 | 2.2704 | −1.5005 | 2.0737 |
| −1.4665 | 1.6122 | 2.0737 | 2.2128 | −1.4808 | 2.0737 |
| −1.4107 | 1.5548 | 2.0737 | 2.1448 | −1.457 | 2.0737 |
| −1.3515 | 1.4932 | 2.0737 | 2.0665 | −1.4291 | 2.0737 |
| −1.2851 | 1.4238 | 2.0737 | 1.9781 | −1.3968 | 2.0737 |
| −1.2113 | 1.3467 | 2.0737 | 1.8796 | −1.3598 | 2.0737 |
| −1.1297 | 1.2622 | 2.0737 | 1.7712 | −1.3177 | 2.0737 |
| −1.0439 | 1.1744 | 2.0737 | 1.6531 | −1.2702 | 2.0737 |
| −0.9537 | 1.0835 | 2.0737 | 1.5304 | −1.2189 | 2.0737 |
| −0.8589 | 0.9896 | 2.0737 | 1.4034 | −1.1638 | 2.0737 |
| −0.7593 | 0.8929 | 2.0737 | 1.2723 | −1.1046 | 2.0737 |
| −0.6549 | 0.7936 | 2.0737 | 1.1376 | −1.0412 | 2.0737 |
| −0.5455 | 0.6919 | 2.0737 | 0.9992 | −0.9732 | 2.0737 |
| −0.4308 | 0.5879 | 2.0737 | 0.8576 | −0.9003 | 2.0737 |
| −0.3109 | 0.4819 | 2.0737 | 0.713 | −0.8219 | 2.0737 |
| −0.1897 | 0.3774 | 2.0737 | 0.5703 | −0.7404 | 2.0737 |
| −0.0672 | 0.2746 | 2.0737 | 0.4298 | −0.6557 | 2.0737 |
| 0.0567 | 0.1735 | 2.0737 | 0.2916 | −0.5673 | 2.0737 |
| 0.1818 | 0.0739 | 2.0737 | 0.156 | −0.4751 | 2.0737 |
| 0.3077 | −0.0248 | 2.0737 | 0.023 | −0.3787 | 2.0737 |
| 0.434 | −0.123 | 2.0737 | −0.1074 | −0.2783 | 2.0737 |
| 0.5605 | −0.2209 | 2.0737 | −0.2354 | −0.1741 | 2.0737 |
| 0.6874 | −0.3183 | 2.0737 | −0.3612 | −0.0666 | 2.0737 |
| 0.8149 | −0.4151 | 2.0737 | −0.4849 | 0.0442 | 2.0737 |
| 0.943 | −0.5108 | 2.0737 | −0.6063 | 0.1585 | 2.0737 |
| 1.072 | −0.6053 | 2.0737 | −0.7248 | 0.2758 | 2.0737 |
| 1.1977 | −0.6954 | 2.0737 | −0.8365 | 0.392 | 2.0737 |
| 1.3199 | −0.7811 | 2.0737 | −0.9415 | 0.5069 | 2.0737 |
| 1.4387 | −0.8624 | 2.0737 | −1.04 | 0.6202 | 2.0737 |
| 1.5539 | −0.9395 | 2.0737 | −1.1322 | 0.7315 | 2.0737 |
| 1.6656 | −1.0125 | 2.0737 | −1.2182 | 0.8408 | 2.0737 |
| 1.7735 | −1.0813 | 2.0737 | −1.2982 | 0.9476 | 2.0737 |
| 1.8776 | −1.1461 | 2.0737 | −1.3722 | 1.052 | 2.0737 |
| 1.9733 | −1.2043 | 2.0737 | −1.4405 | 1.1535 | 2.0737 |
| 2.0604 | −1.2562 | 2.0737 | −1.5003 | 1.2473 | 2.0737 |
| 2.1386 | −1.3021 | 2.0737 | −1.5521 | 1.333 | 2.0737 |
| 2.208 | −1.342 | 2.0737 | −1.5962 | 1.4103 | 2.0737 |
| 2.2683 | −1.3762 | 2.0737 | −1.6355 | 1.4839 | 2.0737 |
| 2.3195 | −1.4049 | 2.0737 | −1.666 | 1.5495 | 2.0737 |
| 2.3634 | −1.4292 | 2.0737 | −1.6847 | 1.6019 | 2.0737 |
| 2.4003 | −1.4495 | 2.0737 | −1.6945 | 1.6452 | 2.0737 |
| 2.4307 | −1.4662 | 2.0737 | −1.6968 | 1.6785 | 2.0737 |
| 2.4551 | −1.4794 | 2.0737 | −1.6931 | 1.7032 | 2.0737 |
| 2.4735 | −1.4901 | 2.0737 | −1.6876 | 1.716 | 2.0737 |
| 2.4835 | −1.5027 | 2.0737 | −1.6823 | 1.7232 | 2.0737 |
| 2.4871 | −1.5158 | 2.0737 | −1.6791 | 1.7262 | 2.0737 |
| 2.4866 | −1.5266 | 2.0737 | −1.6773 | 1.7276 | 2.0737 |
| −1.6148 | 1.7416 | 2.8282 | 2.3808 | −1.7714 | 2.8282 |
| −1.6139 | 1.7422 | 2.8282 | 2.3758 | −1.778 | 2.8282 |
| −1.612 | 1.7432 | 2.8282 | 2.3672 | −1.7848 | 2.8282 |
| −1.608 | 1.745 | 2.8282 | 2.3543 | −1.7893 | 2.8282 |
| −1.5996 | 1.7471 | 2.8282 | 2.3379 | −1.7879 | 2.8282 |
| −1.586 | 1.7472 | 2.8282 | 2.3179 | −1.7786 | 2.8282 |
| −1.5624 | 1.7413 | 2.8282 | 2.292 | −1.7662 | 2.8282 |
| −1.5333 | 1.7273 | 2.8282 | 2.2596 | −1.7506 | 2.8282 |
| −1.4977 | 1.7032 | 2.8282 | 2.2203 | −1.7316 | 2.8282 |
| −1.4566 | 1.6685 | 2.8282 | 2.1736 | −1.7089 | 2.8282 |
| −1.4069 | 1.6197 | 2.8282 | 2.1189 | −1.6822 | 2.8282 |
| −1.3518 | 1.5612 | 2.8282 | 2.0545 | −1.6505 | 2.8282 |
| −1.2934 | 1.4983 | 2.8282 | 1.9803 | −1.6136 | 2.8282 |
| −1.2279 | 1.4275 | 2.8282 | 1.8964 | −1.5713 | 2.8282 |
| −1.155 | 1.349 | 2.8282 | 1.8029 | −1.5236 | 2.8282 |
| −1.0743 | 1.2629 | 2.8282 | 1.6999 | −1.47 | 2.8282 |
| −0.9896 | 1.1734 | 2.8282 | 1.5877 | −1.4104 | 2.8282 |
| −0.9005 | 1.0806 | 2.8282 | 1.4711 | −1.3472 | 2.8282 |
| −0.8069 | 0.9848 | 2.8282 | 1.3503 | −1.2803 | 2.8282 |

TABLE 1-continued

| PRESSURE SIDE | | | SUCTION SIDE | | |
|---|---|---|---|---|---|
| X | Y | Z | X | Y | Z |
| −0.7088 | 0.8859 | 2.8282 | 1.2255 | −1.2097 | 2.8282 |
| −0.606 | 0.784 | 2.8282 | 1.0968 | −1.1352 | 2.8282 |
| −0.4986 | 0.6792 | 2.8282 | 0.9645 | −1.0565 | 2.8282 |
| −0.3865 | 0.5716 | 2.8282 | 0.8289 | −0.9731 | 2.8282 |
| −0.2696 | 0.4613 | 2.8282 | 0.6903 | −0.8847 | 2.8282 |
| −0.1516 | 0.3522 | 2.8282 | 0.5535 | −0.7941 | 2.8282 |
| −0.0326 | 0.2443 | 2.8282 | 0.4186 | −0.701 | 2.8282 |
| 0.0877 | 0.1378 | 2.8282 | 0.2859 | −0.6052 | 2.8282 |
| 0.209 | 0.0324 | 2.8282 | 0.1556 | −0.5062 | 2.8282 |
| 0.331 | −0.0721 | 2.8282 | 0.0281 | −0.4038 | 2.8282 |
| 0.4532 | −0.1765 | 2.8282 | −0.0968 | −0.2979 | 2.8282 |
| 0.5753 | −0.2811 | 2.8282 | −0.2193 | −0.1891 | 2.8282 |
| 0.6972 | −0.3857 | 2.8282 | −0.3396 | −0.0774 | 2.8282 |
| 0.8192 | −0.4904 | 2.8282 | −0.4577 | 0.037 | 2.8282 |
| 0.9413 | −0.5948 | 2.8282 | −0.5738 | 0.1541 | 2.8282 |
| 1.0639 | −0.6988 | 2.8282 | −0.6876 | 0.2739 | 2.8282 |
| 1.1829 | −0.7986 | 2.8282 | −0.7957 | 0.3924 | 2.8282 |
| 1.2984 | −0.8943 | 2.8282 | −0.898 | 0.5093 | 2.8282 |
| 1.4104 | −0.9859 | 2.8282 | −0.9944 | 0.6243 | 2.8282 |
| 1.5186 | −1.0735 | 2.8282 | −1.0847 | 0.7371 | 2.8282 |
| 1.6233 | −1.1571 | 2.8282 | −1.169 | 0.8476 | 2.8282 |
| 1.7242 | −1.2367 | 2.8282 | −1.2474 | 0.9557 | 2.8282 |
| 1.8215 | −1.3124 | 2.8282 | −1.3197 | 1.0611 | 2.8282 |
| 1.9107 | −1.381 | 2.8282 | −1.3865 | 1.1636 | 2.8282 |
| 1.9918 | −1.4425 | 2.8282 | −1.4449 | 1.2583 | 2.8282 |
| 2.0646 | −1.4972 | 2.8282 | −1.4954 | 1.3447 | 2.8282 |
| 2.1291 | −1.5452 | 2.8282 | −1.5383 | 1.4227 | 2.8282 |
| 2.185 | −1.5866 | 2.8282 | −1.5766 | 1.4967 | 2.8282 |
| 2.2325 | −1.6216 | 2.8282 | −1.6063 | 1.5627 | 2.8282 |
| 2.2731 | −1.6514 | 2.8282 | −1.6244 | 1.6152 | 2.8282 |
| 2.3073 | −1.6764 | 2.8282 | −1.6338 | 1.6587 | 2.8282 |
| 2.3354 | −1.6969 | 2.8282 | −1.6357 | 1.692 | 2.8282 |
| 2.3579 | −1.7133 | 2.8282 | −1.6318 | 1.7167 | 2.8282 |
| 2.375 | −1.7262 | 2.8282 | −1.6262 | 1.7295 | 2.8282 |
| 2.3837 | −1.7398 | 2.8282 | −1.6208 | 1.7365 | 2.8282 |
| 2.3859 | −1.7532 | 2.8282 | −1.6175 | 1.7396 | 2.8282 |
| 2.3841 | −1.7639 | 2.8282 | −1.6158 | 1.7409 | 2.8282 |
| −1.5265 | 1.7991 | 3.5826 | 2.245 | −2.0025 | 3.5826 |
| −1.5256 | 1.7996 | 3.5826 | 2.2393 | −2.0084 | 3.5826 |
| −1.5237 | 1.8007 | 3.5826 | 2.2299 | −2.0141 | 3.5826 |
| −1.5196 | 1.8023 | 3.5826 | 2.2164 | −2.0166 | 3.5826 |
| −1.511 | 1.8041 | 3.5826 | 2.2005 | −2.0126 | 3.5826 |
| −1.4974 | 1.8037 | 3.5826 | 2.1818 | −2.0007 | 3.5826 |
| −1.4739 | 1.7967 | 3.5826 | 2.1577 | −1.9852 | 3.5826 |
| −1.4452 | 1.7815 | 3.5826 | 2.1275 | −1.9657 | 3.5826 |
| −1.4102 | 1.7561 | 3.5826 | 2.0908 | −1.9421 | 3.5826 |
| −1.3699 | 1.72 | 3.5826 | 2.0472 | −1.914 | 3.5826 |
| −1.3212 | 1.6696 | 3.5826 | 1.9961 | −1.8811 | 3.5826 |
| −1.2674 | 1.6094 | 3.5826 | 1.9359 | −1.8422 | 3.5826 |
| −1.2104 | 1.5446 | 3.5826 | 1.8664 | −1.7971 | 3.5826 |
| −1.1466 | 1.4716 | 3.5826 | 1.7877 | −1.7458 | 3.5826 |
| −1.0757 | 1.3904 | 3.5826 | 1.7 | −1.6884 | 3.5826 |
| −0.9976 | 1.3012 | 3.5826 | 1.6032 | −1.6245 | 3.5826 |
| −0.9156 | 1.2083 | 3.5826 | 1.4974 | −1.5542 | 3.5826 |
| −0.8295 | 1.1117 | 3.5826 | 1.3874 | −1.4803 | 3.5826 |
| −0.7393 | 1.0116 | 3.5826 | 1.2733 | −1.4027 | 3.5826 |
| −0.645 | 0.908 | 3.5826 | 1.1552 | −1.3214 | 3.5826 |
| −0.5466 | 0.8009 | 3.5826 | 1.0334 | −1.236 | 3.5826 |
| −0.4439 | 0.6904 | 3.5826 | 0.908 | −1.1465 | 3.5826 |
| −0.3369 | 0.5766 | 3.5826 | 0.7793 | −1.0524 | 3.5826 |
| −0.2254 | 0.4595 | 3.5826 | 0.6476 | −0.9535 | 3.5826 |
| −0.1131 | 0.3433 | 3.5826 | 0.5176 | −0.8526 | 3.5826 |
| 0.0002 | 0.228 | 3.5826 | 0.3896 | −0.7497 | 3.5826 |
| 0.1146 | 0.1137 | 3.5826 | 0.2638 | −0.6442 | 3.5826 |
| 0.2299 | 0.0004 | 3.5826 | 0.1406 | −0.5359 | 3.5826 |
| 0.3458 | −0.1124 | 3.5826 | 0.0201 | −0.4246 | 3.5826 |
| 0.4616 | −0.2253 | 3.5826 | −0.0977 | −0.3103 | 3.5826 |
| 0.577 | −0.3385 | 3.5826 | −0.2132 | −0.1934 | 3.5826 |
| 0.6921 | −0.4521 | 3.5826 | −0.3266 | −0.0742 | 3.5826 |
| 0.8069 | −0.5661 | 3.5826 | −0.438 | 0.0472 | 3.5826 |
| 0.9216 | −0.6801 | 3.5826 | −0.5473 | 0.1708 | 3.5826 |
| 1.0362 | −0.7941 | 3.5826 | −0.6546 | 0.2968 | 3.5826 |
| 1.1473 | −0.9042 | 3.5826 | −0.7564 | 0.4207 | 3.5826 |
| 1.2547 | −1.0102 | 3.5826 | −0.8527 | 0.5425 | 3.5826 |
| 1.3587 | −1.1121 | 3.5826 | −0.9436 | 0.6617 | 3.5826 |
| 1.459 | −1.2099 | 3.5826 | −1.0288 | 0.7782 | 3.5826 |

TABLE 1-continued

| PRESSURE SIDE | | | SUCTION SIDE | | |
|---|---|---|---|---|---|
| X | Y | Z | X | Y | Z |
| 1.5558 | −1.3036 | 3.5826 | −1.1085 | 0.8918 | 3.5826 |
| 1.6491 | −1.3933 | 3.5826 | −1.1825 | 1.0026 | 3.5826 |
| 1.7386 | −1.4791 | 3.5826 | −1.2509 | 1.1104 | 3.5826 |
| 1.8206 | −1.5571 | 3.5826 | −1.3139 | 1.215 | 3.5826 |
| 1.8949 | −1.6276 | 3.5826 | −1.3691 | 1.3114 | 3.5826 |
| 1.9615 | −1.6905 | 3.5826 | −1.4167 | 1.3993 | 3.5826 |
| 2.0203 | −1.7461 | 3.5826 | −1.4572 | 1.4783 | 3.5826 |
| 2.0713 | −1.7942 | 3.5826 | −1.4933 | 1.5534 | 3.5826 |
| 2.1144 | −1.8349 | 3.5826 | −1.521 | 1.6201 | 3.5826 |
| 2.1513 | −1.8696 | 3.5826 | −1.5378 | 1.673 | 3.5826 |
| 2.1823 | −1.8988 | 3.5826 | −1.5463 | 1.7165 | 3.5826 |
| 2.2078 | −1.9228 | 3.5826 | −1.5478 | 1.7498 | 3.5826 |
| 2.2282 | −1.942 | 3.5826 | −1.5438 | 1.7744 | 3.5826 |
| 2.2438 | −1.9569 | 3.5826 | −1.5381 | 1.7871 | 3.5826 |
| 2.2513 | −1.9713 | 3.5826 | −1.5327 | 1.7941 | 3.5826 |
| 2.2522 | −1.9849 | 3.5826 | −1.5293 | 1.7971 | 3.5826 |
| 2.2492 | −1.9954 | 3.5826 | −1.5275 | 1.7985 | 3.5826 |
| −1.4339 | 1.8514 | 4.3372 | 2.1061 | −2.2124 | 4.3372 |
| −1.433 | 1.852 | 4.3372 | 2.0997 | −2.2177 | 4.3372 |
| −1.431 | 1.8529 | 4.3372 | 2.0897 | −2.2222 | 4.3372 |
| −1.4269 | 1.8545 | 4.3372 | 2.076 | −2.2229 | 4.3372 |
| −1.4181 | 1.8559 | 4.3372 | 2.0609 | −2.2166 | 4.3372 |
| −1.4044 | 1.8547 | 4.3372 | 2.0437 | −2.2027 | 4.3372 |
| −1.3812 | 1.8466 | 4.3372 | 2.0214 | −2.1847 | 4.3372 |
| −1.353 | 1.83 | 4.3372 | 1.9934 | −2.1622 | 4.3372 |
| −1.3188 | 1.8031 | 4.3372 | 1.9595 | −2.1348 | 4.3372 |
| −1.2796 | 1.7654 | 4.3372 | 1.9191 | −2.1023 | 4.3372 |
| −1.2323 | 1.7131 | 4.3372 | 1.8717 | −2.0642 | 4.3372 |
| −1.1798 | 1.651 | 4.3372 | 1.8158 | −2.0193 | 4.3372 |
| −1.1245 | 1.5841 | 4.3372 | 1.7513 | −1.9674 | 4.3372 |
| −1.0627 | 1.5086 | 4.3372 | 1.6783 | −1.9085 | 4.3372 |
| −0.9942 | 1.4244 | 4.3372 | 1.5967 | −1.8426 | 4.3372 |
| −0.919 | 1.3319 | 4.3372 | 1.5065 | −1.7698 | 4.3372 |
| −0.8402 | 1.2351 | 4.3372 | 1.4079 | −1.6898 | 4.3372 |
| −0.7578 | 1.1344 | 4.3372 | 1.3052 | −1.6062 | 4.3372 |
| −0.6717 | 1.0296 | 4.3372 | 1.1985 | −1.5187 | 4.3372 |
| −0.5819 | 0.9209 | 4.3372 | 1.088 | −1.4273 | 4.3372 |
| −0.4882 | 0.8084 | 4.3372 | 0.9737 | −1.3319 | 4.3372 |
| −0.3906 | 0.6921 | 4.3372 | 0.856 | −1.2322 | 4.3372 |
| −0.2889 | 0.5721 | 4.3372 | 0.7351 | −1.128 | 4.3372 |
| −0.183 | 0.4486 | 4.3372 | 0.6112 | −1.0189 | 4.3372 |
| −0.0765 | 0.3256 | 4.3372 | 0.489 | −0.9082 | 4.3372 |
| 0.0308 | 0.2033 | 4.3372 | 0.3686 | −0.7957 | 4.3372 |
| 0.1389 | 0.0817 | 4.3372 | 0.2504 | −0.6811 | 4.3372 |
| 0.2477 | −0.0394 | 4.3372 | 0.1346 | −0.564 | 4.3372 |
| 0.3567 | −0.1602 | 4.3372 | 0.0214 | −0.4444 | 4.3372 |
| 0.4653 | −0.2814 | 4.3372 | −0.0893 | −0.3223 | 4.3372 |
| 0.5734 | −0.4031 | 4.3372 | −0.1978 | −0.1981 | 4.3372 |
| 0.6808 | −0.5253 | 4.3372 | −0.3045 | −0.0721 | 4.3372 |
| 0.7878 | −0.648 | 4.3372 | −0.4094 | 0.0557 | 4.3372 |
| 0.8944 | −0.7709 | 4.3372 | −0.5124 | 0.1853 | 4.3372 |
| 1.0008 | −0.8941 | 4.3372 | −0.6134 | 0.317 | 4.3372 |
| 1.1036 | −1.0132 | 4.3372 | −0.7091 | 0.4461 | 4.3372 |
| 1.2029 | −1.1281 | 4.3372 | −0.7995 | 0.5724 | 4.3372 |
| 1.2987 | −1.2388 | 4.3372 | −0.8846 | 0.6956 | 4.3372 |
| 1.3912 | −1.3454 | 4.3372 | −0.9645 | 0.8156 | 4.3372 |
| 1.4802 | −1.4477 | 4.3372 | −1.0393 | 0.9323 | 4.3372 |
| 1.5658 | −1.5458 | 4.3372 | −1.109 | 1.0457 | 4.3372 |
| 1.6479 | −1.6398 | 4.3372 | −1.1734 | 1.1558 | 4.3372 |
| 1.7229 | −1.7255 | 4.3372 | −1.2329 | 1.2624 | 4.3372 |
| 1.7908 | −1.8031 | 4.3372 | −1.285 | 1.3603 | 4.3372 |
| 1.8515 | −1.8724 | 4.3372 | −1.33 | 1.4494 | 4.3372 |
| 1.9051 | −1.9337 | 4.3372 | −1.3684 | 1.5295 | 4.3372 |
| 1.9514 | −1.9869 | 4.3372 | −1.4025 | 1.6053 | 4.3372 |
| 1.9906 | −2.0319 | 4.3372 | −1.429 | 1.6724 | 4.3372 |
| 2.0241 | −2.0703 | 4.3372 | −1.4451 | 1.7255 | 4.3372 |
| 2.0523 | −2.1026 | 4.3372 | −1.4534 | 1.769 | 4.3372 |
| 2.0755 | −2.1292 | 4.3372 | −1.4549 | 1.8022 | 4.3372 |
| 2.0941 | −2.1504 | 4.3372 | −1.451 | 1.8268 | 4.3372 |
| 2.1084 | −2.1667 | 4.3372 | −1.4455 | 1.8396 | 4.3372 |
| 2.115 | −2.1816 | 4.3372 | −1.4401 | 1.8466 | 4.3372 |
| 2.1149 | −2.1954 | 4.3372 | −1.4367 | 1.8495 | 4.3372 |
| 2.111 | −2.2057 | 4.3372 | −1.4349 | 1.8508 | 4.3372 |
| −1.3602 | 1.8897 | 5.0916 | 1.9977 | −2.3671 | 5.0916 |
| −1.3592 | 1.8902 | 5.0916 | 1.9911 | −2.3719 | 5.0916 |
| −1.3572 | 1.8912 | 5.0916 | 1.9807 | −2.3756 | 5.0916 |

TABLE 1-continued

| PRESSURE SIDE | | | SUCTION SIDE | | |
|---|---|---|---|---|---|
| X | Y | Z | X | Y | Z |
| −1.353 | 1.8925 | 5.0916 | 1.9669 | −2.3751 | 5.0916 |
| −1.3441 | 1.8934 | 5.0916 | 1.9525 | −2.3672 | 5.0916 |
| −1.3305 | 1.8913 | 5.0916 | 1.9363 | −2.3521 | 5.0916 |
| −1.3077 | 1.8815 | 5.0916 | 1.9153 | −2.3326 | 5.0916 |
| −1.2804 | 1.8632 | 5.0916 | 1.8889 | −2.3081 | 5.0916 |
| −1.2473 | 1.8343 | 5.0916 | 1.8569 | −2.2784 | 5.0916 |
| −1.2096 | 1.7948 | 5.0916 | 1.8188 | −2.2431 | 5.0916 |
| −1.1641 | 1.7405 | 5.0916 | 1.7741 | −2.2018 | 5.0916 |
| −1.1135 | 1.6762 | 5.0916 | 1.7214 | −2.1529 | 5.0916 |
| −1.0601 | 1.6071 | 5.0916 | 1.6606 | −2.0965 | 5.0916 |
| −1.0005 | 1.5291 | 5.0916 | 1.5917 | −2.0325 | 5.0916 |
| −0.9346 | 1.4421 | 5.0916 | 1.5148 | −1.961 | 5.0916 |
| −0.8622 | 1.3463 | 5.0916 | 1.4298 | −1.8819 | 5.0916 |
| −0.7867 | 1.2461 | 5.0916 | 1.3369 | −1.795 | 5.0916 |
| −0.7079 | 1.1415 | 5.0916 | 1.2402 | −1.7042 | 5.0916 |
| −0.6256 | 1.0327 | 5.0916 | 1.1397 | −1.6094 | 5.0916 |
| −0.5399 | 0.9197 | 5.0916 | 1.0355 | −1.5104 | 5.0916 |
| −0.4505 | 0.8026 | 5.0916 | 0.9278 | −1.4072 | 5.0916 |
| −0.3573 | 0.6815 | 5.0916 | 0.8168 | −1.2996 | 5.0916 |
| −0.2603 | 0.5565 | 5.0916 | 0.7027 | −1.1873 | 5.0916 |
| −0.1594 | 0.4277 | 5.0916 | 0.586 | −1.0701 | 5.0916 |
| −0.0579 | 0.2992 | 5.0916 | 0.4707 | −0.9515 | 5.0916 |
| 0.0441 | 0.1712 | 5.0916 | 0.3572 | −0.8313 | 5.0916 |
| 0.1468 | 0.0437 | 5.0916 | 0.2458 | −0.7093 | 5.0916 |
| 0.25 | −0.0834 | 5.0916 | 0.1366 | −0.5853 | 5.0916 |
| 0.3532 | −0.2104 | 5.0916 | 0.0298 | −0.4592 | 5.0916 |
| 0.4559 | −0.3379 | 5.0916 | −0.0747 | −0.3311 | 5.0916 |
| 0.558 | −0.4658 | 5.0916 | −0.1774 | −0.2013 | 5.0916 |
| 0.6593 | −0.5944 | 5.0916 | −0.2786 | −0.0701 | 5.0916 |
| 0.7601 | −0.7234 | 5.0916 | −0.3781 | 0.0625 | 5.0916 |
| 0.8605 | −0.8527 | 5.0916 | −0.4759 | 0.1966 | 5.0916 |
| 0.9606 | −0.9822 | 5.0916 | −0.5718 | 0.3324 | 5.0916 |
| 1.0573 | −1.1075 | 5.0916 | −0.6626 | 0.4652 | 5.0916 |
| 1.1507 | −1.2284 | 5.0916 | −0.7484 | 0.5947 | 5.0916 |
| 1.2408 | −1.345 | 5.0916 | −0.8292 | 0.7208 | 5.0916 |
| 1.3277 | −1.4571 | 5.0916 | −0.9052 | 0.8435 | 5.0916 |
| 1.4113 | −1.5649 | 5.0916 | −0.9764 | 0.9625 | 5.0916 |
| 1.4917 | −1.6683 | 5.0916 | −1.0429 | 1.0779 | 5.0916 |
| 1.5688 | −1.7673 | 5.0916 | −1.1046 | 1.1896 | 5.0916 |
| 1.6392 | −1.8577 | 5.0916 | −1.1619 | 1.2974 | 5.0916 |
| 1.7031 | −1.9394 | 5.0916 | −1.2121 | 1.3964 | 5.0916 |
| 1.7602 | −2.0125 | 5.0916 | −1.2557 | 1.4862 | 5.0916 |
| 1.8105 | −2.077 | 5.0916 | −1.2928 | 1.5669 | 5.0916 |
| 1.8541 | −2.133 | 5.0916 | −1.3262 | 1.6431 | 5.0916 |
| 1.891 | −2.1804 | 5.0916 | −1.3523 | 1.7104 | 5.0916 |
| 1.9225 | −2.2208 | 5.0916 | −1.3686 | 1.7634 | 5.0916 |
| 1.9491 | −2.2548 | 5.0916 | −1.3774 | 1.8069 | 5.0916 |
| 1.971 | −2.2826 | 5.0916 | −1.3796 | 1.84 | 5.0916 |
| 1.9886 | −2.3049 | 5.0916 | −1.3766 | 1.8648 | 5.0916 |
| 2.0021 | −2.322 | 5.0916 | −1.3716 | 1.8777 | 5.0916 |
| 2.0082 | −2.3371 | 5.0916 | −1.3663 | 1.8849 | 5.0916 |
| 2.0074 | −2.3507 | 5.0916 | −1.363 | 1.8878 | 5.0916 |
| 2.003 | −2.3607 | 5.0916 | −1.3611 | 1.8891 | 5.0916 |
| −1.3138 | 1.9166 | 5.846 | 1.9298 | −2.4723 | 5.846 |
| −1.3128 | 1.9171 | 5.846 | 1.923 | −2.477 | 5.846 |
| −1.3108 | 1.918 | 5.846 | 1.9124 | −2.4802 | 5.846 |
| −1.3064 | 1.9191 | 5.846 | 1.8986 | −2.4789 | 5.846 |
| −1.2975 | 1.9192 | 5.846 | 1.8847 | −2.47 | 5.846 |
| −1.2841 | 1.9157 | 5.846 | 1.869 | −2.4543 | 5.846 |
| −1.2621 | 1.9039 | 5.846 | 1.8487 | −2.4338 | 5.846 |
| −1.236 | 1.8837 | 5.846 | 1.8232 | −2.4083 | 5.846 |
| −1.2044 | 1.8528 | 5.846 | 1.7922 | −2.3772 | 5.846 |
| −1.1686 | 1.8113 | 5.846 | 1.7554 | −2.3403 | 5.846 |
| −1.1251 | 1.7548 | 5.846 | 1.7123 | −2.297 | 5.846 |
| −1.0766 | 1.6882 | 5.846 | 1.6614 | −2.2459 | 5.846 |
| −1.0254 | 1.6169 | 5.846 | 1.6027 | −2.1868 | 5.846 |
| −0.9682 | 1.5363 | 5.846 | 1.5363 | −2.1197 | 5.846 |
| −0.905 | 1.4466 | 5.846 | 1.4622 | −2.0447 | 5.846 |
| −0.8355 | 1.3478 | 5.846 | 1.3804 | −1.9617 | 5.846 |
| −0.763 | 1.2445 | 5.846 | 1.2911 | −1.8705 | 5.846 |
| −0.6872 | 1.1367 | 5.846 | 1.1981 | −1.7751 | 5.846 |
| −0.6082 | 1.0246 | 5.846 | 1.1016 | −1.6755 | 5.846 |
| −0.5257 | 0.9081 | 5.846 | 1.0017 | −1.5714 | 5.846 |
| −0.4397 | 0.7874 | 5.846 | 0.8985 | −1.463 | 5.846 |
| −0.3501 | 0.6625 | 5.846 | 0.7922 | −1.3498 | 5.846 |
| −0.2568 | 0.5336 | 5.846 | 0.6831 | −1.2319 | 5.846 |

TABLE 1-continued

| PRESSURE SIDE | | | SUCTION SIDE | | |
|---|---|---|---|---|---|
| X | Y | Z | X | Y | Z |
| −0.1597 | 0.4005 | 5.846 | 0.5715 | −1.1088 | 5.846 |
| −0.0621 | 0.2679 | 5.846 | 0.4613 | −0.9846 | 5.846 |
| 0.0359 | 0.1356 | 5.846 | 0.3529 | −0.8588 | 5.846 |
| 0.1346 | 0.0038 | 5.846 | 0.2465 | −0.7315 | 5.846 |
| 0.2338 | −0.1277 | 5.846 | 0.1422 | −0.6023 | 5.846 |
| 0.3332 | −0.259 | 5.846 | 0.04 | −0.4714 | 5.846 |
| 0.4323 | −0.3904 | 5.846 | −0.0602 | −0.3389 | 5.846 |
| 0.531 | −0.5223 | 5.846 | −0.1588 | −0.205 | 5.846 |
| 0.629 | −0.6546 | 5.846 | −0.2559 | −0.07 | 5.846 |
| 0.7265 | −0.7873 | 5.846 | −0.3516 | 0.0663 | 5.846 |
| 0.8236 | −0.9203 | 5.846 | −0.4458 | 0.2038 | 5.846 |
| 0.9205 | −1.0534 | 5.846 | −0.5382 | 0.3428 | 5.846 |
| 1.0141 | −1.1821 | 5.846 | −0.6257 | 0.4783 | 5.846 |
| 1.1046 | −1.3064 | 5.846 | −0.7085 | 0.6102 | 5.846 |
| 1.1919 | −1.4261 | 5.846 | −0.7867 | 0.7384 | 5.846 |
| 1.2762 | −1.5412 | 5.846 | −0.8603 | 0.8629 | 5.846 |
| 1.3574 | −1.6519 | 5.846 | −0.9295 | 0.9836 | 5.846 |
| 1.4355 | −1.7579 | 5.846 | −0.9942 | 1.1003 | 5.846 |
| 1.5106 | −1.8594 | 5.846 | −1.0546 | 1.2132 | 5.846 |
| 1.5792 | −1.952 | 5.846 | −1.1107 | 1.3219 | 5.846 |
| 1.6414 | −2.0357 | 5.846 | −1.1602 | 1.4216 | 5.846 |
| 1.6972 | −2.1106 | 5.846 | −1.2034 | 1.512 | 5.846 |
| 1.7464 | −2.1766 | 5.846 | −1.2404 | 1.5929 | 5.846 |
| 1.789 | −2.2338 | 5.846 | −1.2738 | 1.6694 | 5.846 |
| 1.8251 | −2.2822 | 5.846 | −1.3004 | 1.7366 | 5.846 |
| 1.856 | −2.3235 | 5.846 | −1.3175 | 1.7896 | 5.846 |
| 1.882 | −2.3582 | 5.846 | −1.3273 | 1.833 | 5.846 |
| 1.9035 | −2.3867 | 5.846 | −1.3307 | 1.8661 | 5.846 |
| 1.9207 | −2.4094 | 5.846 | −1.329 | 1.891 | 5.846 |
| 1.934 | −2.4269 | 5.846 | −1.3247 | 1.9043 | 5.846 |
| 1.9406 | −2.442 | 5.846 | −1.3199 | 1.9117 | 5.846 |
| 1.9399 | −2.4558 | 5.846 | −1.3166 | 1.9148 | 5.846 |
| 1.9354 | −2.466 | 5.846 | −1.3148 | 1.916 | 5.846 |
| −1.2824 | 1.9231 | 6.6005 | 1.8935 | −2.5564 | 6.6005 |
| −1.2814 | 1.9236 | 6.6005 | 1.8865 | −2.561 | 6.6005 |
| −1.2793 | 1.9244 | 6.6005 | 1.8758 | −2.5639 | 6.6005 |
| −1.2748 | 1.9252 | 6.6005 | 1.862 | −2.5621 | 6.6005 |
| −1.2659 | 1.9246 | 6.6005 | 1.8484 | −2.5526 | 6.6005 |
| −1.2528 | 1.9197 | 6.6005 | 1.833 | −2.5365 | 6.6005 |
| −1.2317 | 1.9063 | 6.6005 | 1.813 | −2.5155 | 6.6005 |
| −1.2067 | 1.8843 | 6.6005 | 1.788 | −2.4893 | 6.6005 |
| −1.1767 | 1.8517 | 6.6005 | 1.7576 | −2.4574 | 6.6005 |
| −1.1425 | 1.8085 | 6.6005 | 1.7214 | −2.4195 | 6.6005 |
| −1.1008 | 1.7502 | 6.6005 | 1.6791 | −2.3751 | 6.6005 |
| −1.0542 | 1.6817 | 6.6005 | 1.6292 | −2.3226 | 6.6005 |
| −1.005 | 1.6084 | 6.6005 | 1.5717 | −2.2619 | 6.6005 |
| −0.9499 | 1.5257 | 6.6005 | 1.5067 | −2.1929 | 6.6005 |
| −0.8889 | 1.4337 | 6.6005 | 1.4342 | −2.1157 | 6.6005 |
| −0.8218 | 1.3324 | 6.6005 | 1.3543 | −2.0302 | 6.6005 |
| −0.7517 | 1.2266 | 6.6005 | 1.2671 | −1.9363 | 6.6005 |
| −0.6783 | 1.1162 | 6.6005 | 1.1764 | −1.8379 | 6.6005 |
| −0.6017 | 1.0014 | 6.6005 | 1.0824 | −1.7351 | 6.6005 |
| −0.5217 | 0.8822 | 6.6005 | 0.9852 | −1.6277 | 6.6005 |
| −0.4383 | 0.7587 | 6.6005 | 0.8849 | −1.5157 | 6.6005 |
| −0.3513 | 0.6309 | 6.6005 | 0.7818 | −1.3988 | 6.6005 |
| −0.2607 | 0.499 | 6.6005 | 0.676 | −1.277 | 6.6005 |
| −0.1663 | 0.3629 | 6.6005 | 0.5678 | −1.1499 | 6.6005 |
| −0.0714 | 0.2271 | 6.6005 | 0.4611 | −1.0217 | 6.6005 |
| 0.024 | 0.0918 | 6.6005 | 0.356 | −0.8921 | 6.6005 |
| 0.12 | −0.0432 | 6.6005 | 0.2529 | −0.7609 | 6.6005 |
| 0.2167 | −0.1777 | 6.6005 | 0.1519 | −0.6282 | 6.6005 |
| 0.3137 | −0.3119 | 6.6005 | 0.0527 | −0.4939 | 6.6005 |
| 0.4108 | −0.4461 | 6.6005 | −0.0447 | −0.3582 | 6.6005 |
| 0.5076 | −0.5805 | 6.6005 | −0.1407 | −0.2214 | 6.6005 |
| 0.604 | −0.7153 | 6.6005 | −0.2355 | −0.0835 | 6.6005 |
| 0.6999 | −0.8503 | 6.6005 | −0.3288 | 0.0554 | 6.6005 |
| 0.7956 | −0.9855 | 6.6005 | −0.4206 | 0.1954 | 6.6005 |
| 0.8912 | −1.1208 | 6.6005 | −0.5107 | 0.3365 | 6.6005 |
| 0.9837 | −1.2515 | 6.6005 | −0.5962 | 0.474 | 6.6005 |
| 1.0731 | −1.3776 | 6.6005 | −0.6771 | 0.6077 | 6.6005 |
| 1.1596 | −1.4991 | 6.6005 | −0.7536 | 0.7375 | 6.6005 |
| 1.2431 | −1.6158 | 6.6005 | −0.8258 | 0.8634 | 6.6005 |
| 1.3236 | −1.728 | 6.6005 | −0.8937 | 0.9853 | 6.6005 |
| 1.4012 | −1.8354 | 6.6005 | −0.9575 | 1.1031 | 6.6005 |
| 1.4757 | −1.9383 | 6.6005 | −1.0171 | 1.2168 | 6.6005 |
| 1.5439 | −2.032 | 6.6005 | −1.0727 | 1.3263 | 6.6005 |

TABLE 1-continued

| PRESSURE SIDE | | | SUCTION SIDE | | |
|---|---|---|---|---|---|
| X | Y | Z | X | Y | Z |
| 1.6059 | −2.1167 | 6.6005 | −1.122 | 1.4265 | 6.6005 |
| 1.6614 | −2.1924 | 6.6005 | −1.1651 | 1.5173 | 6.6005 |
| 1.7105 | −2.2591 | 6.6005 | −1.2022 | 1.5985 | 6.6005 |
| 1.753 | −2.3169 | 6.6005 | −1.236 | 1.6751 | 6.6005 |
| 1.789 | −2.3658 | 6.6005 | −1.2633 | 1.7424 | 6.6005 |
| 1.8199 | −2.4076 | 6.6005 | −1.2812 | 1.7953 | 6.6005 |
| 1.8459 | −2.4426 | 6.6005 | −1.292 | 1.8386 | 6.6005 |
| 1.8674 | −2.4713 | 6.6005 | −1.2966 | 1.8717 | 6.6005 |
| 1.8847 | −2.4943 | 6.6005 | −1.2961 | 1.8968 | 6.6005 |
| 1.898 | −2.5119 | 6.6005 | −1.2928 | 1.9103 | 6.6005 |
| 1.9044 | −2.5268 | 6.6005 | −1.2884 | 1.9181 | 6.6005 |
| 1.9037 | −2.5404 | 6.6005 | −1.2852 | 1.9212 | 6.6005 |
| 1.899 | −2.5503 | 6.6005 | −1.2834 | 1.9225 | 6.6005 |
| −1.2585 | 1.91 | 7.355 | 1.8785 | −2.6214 | 7.355 |
| −1.2574 | 1.9104 | 7.355 | 1.8714 | −2.6259 | 7.355 |
| −1.2553 | 1.9112 | 7.355 | 1.8606 | −2.6287 | 7.355 |
| −1.2508 | 1.9118 | 7.355 | 1.8468 | −2.6265 | 7.355 |
| −1.2419 | 1.9105 | 7.355 | 1.8334 | −2.6167 | 7.355 |
| −1.2291 | 1.9049 | 7.355 | 1.818 | −2.6005 | 7.355 |
| −1.2087 | 1.8903 | 7.355 | 1.798 | −2.5794 | 7.355 |
| −1.1846 | 1.8673 | 7.355 | 1.7731 | −2.553 | 7.355 |
| −1.1556 | 1.8338 | 7.355 | 1.7427 | −2.5209 | 7.355 |
| −1.1225 | 1.7896 | 7.355 | 1.7066 | −2.4826 | 7.355 |
| −1.082 | 1.7301 | 7.355 | 1.6645 | −2.4378 | 7.355 |
| −1.0367 | 1.6604 | 7.355 | 1.6148 | −2.3848 | 7.355 |
| −0.9888 | 1.5859 | 7.355 | 1.5575 | −2.3235 | 7.355 |
| −0.935 | 1.5019 | 7.355 | 1.4929 | −2.2538 | 7.355 |
| −0.8755 | 1.4085 | 7.355 | 1.4209 | −2.1757 | 7.355 |
| −0.81 | 1.3058 | 7.355 | 1.3416 | −2.0892 | 7.355 |
| −0.7414 | 1.1984 | 7.355 | 1.2552 | −1.994 | 7.355 |
| −0.6697 | 1.0865 | 7.355 | 1.1655 | −1.8942 | 7.355 |
| −0.5947 | 0.9701 | 7.355 | 1.0726 | −1.7898 | 7.355 |
| −0.5164 | 0.8492 | 7.355 | 0.9767 | −1.6808 | 7.355 |
| −0.4346 | 0.724 | 7.355 | 0.8779 | −1.5669 | 7.355 |
| −0.3494 | 0.5945 | 7.355 | 0.7765 | −1.448 | 7.355 |
| −0.2605 | 0.4607 | 7.355 | 0.6725 | −1.324 | 7.355 |
| −0.168 | 0.3227 | 7.355 | 0.5664 | −1.1946 | 7.355 |
| −0.0748 | 0.1851 | 7.355 | 0.4617 | −1.0641 | 7.355 |
| 0.0189 | 0.0479 | 7.355 | 0.3588 | −0.9322 | 7.355 |
| 0.1133 | −0.0889 | 7.355 | 0.2578 | −0.7987 | 7.355 |
| 0.2084 | −0.2252 | 7.355 | 0.1588 | −0.6638 | 7.355 |
| 0.304 | −0.3611 | 7.355 | 0.0616 | −0.5274 | 7.355 |
| 0.3998 | −0.4968 | 7.355 | −0.034 | −0.3898 | 7.355 |
| 0.4955 | −0.6327 | 7.355 | −0.1283 | −0.2512 | 7.355 |
| 0.5909 | −0.7687 | 7.355 | −0.2214 | −0.1116 | 7.355 |
| 0.6861 | −0.905 | 7.355 | −0.3131 | 0.0291 | 7.355 |
| 0.7811 | −1.0413 | 7.355 | −0.4033 | 0.1707 | 7.355 |
| 0.8761 | −1.1776 | 7.355 | −0.4918 | 0.3133 | 7.355 |
| 0.9681 | −1.3093 | 7.355 | −0.5758 | 0.4521 | 7.355 |
| 1.0572 | −1.4362 | 7.355 | −0.6555 | 0.5871 | 7.355 |
| 1.1433 | −1.5585 | 7.355 | −0.7307 | 0.7181 | 7.355 |
| 1.2266 | −1.676 | 7.355 | −0.8018 | 0.8451 | 7.355 |
| 1.3069 | −1.7888 | 7.355 | −0.8688 | 0.9679 | 7.355 |
| 1.3843 | −1.8969 | 7.355 | −0.9317 | 1.0866 | 7.355 |
| 1.4587 | −2.0003 | 7.355 | −0.9907 | 1.201 | 7.355 |
| 1.5269 | −2.0945 | 7.355 | −1.0458 | 1.3111 | 7.355 |
| 1.5889 | −2.1796 | 7.355 | −1.0947 | 1.4118 | 7.355 |
| 1.6444 | −2.2556 | 7.355 | −1.1375 | 1.503 | 7.355 |
| 1.6936 | −2.3226 | 7.355 | −1.1746 | 1.5845 | 7.355 |
| 1.7362 | −2.3806 | 7.355 | −1.2084 | 1.6613 | 7.355 |
| 1.7724 | −2.4297 | 7.355 | −1.2359 | 1.7287 | 7.355 |
| 1.8034 | −2.4715 | 7.355 | −1.2542 | 1.7816 | 7.355 |
| 1.8295 | −2.5066 | 7.355 | −1.2656 | 1.8249 | 7.355 |
| 1.8511 | −2.5354 | 7.355 | −1.2709 | 1.858 | 7.355 |
| 1.8685 | −2.5584 | 7.355 | −1.2712 | 1.8832 | 7.355 |
| 1.8819 | −2.576 | 7.355 | −1.2684 | 1.8969 | 7.355 |
| 1.8891 | −2.5909 | 7.355 | −1.2644 | 1.9048 | 7.355 |
| 1.8887 | −2.6049 | 7.355 | −1.2613 | 1.9081 | 7.355 |
| 1.8841 | −2.6151 | 7.355 | −1.2595 | 1.9094 | 7.355 |
| −1.2401 | 1.8835 | 8.1095 | 1.8766 | −2.6648 | 8.1095 |
| −1.239 | 1.884 | 8.1095 | 1.8695 | −2.6694 | 8.1095 |
| −1.2369 | 1.8848 | 8.1095 | 1.8587 | −2.6722 | 8.1095 |
| −1.2324 | 1.8853 | 8.1095 | 1.8449 | −2.67 | 8.1095 |
| −1.2236 | 1.8836 | 8.1095 | 1.8316 | −2.66 | 8.1095 |
| −1.2109 | 1.8776 | 8.1095 | 1.816 | −2.6439 | 8.1095 |
| −1.191 | 1.8625 | 8.1095 | 1.7958 | −2.623 | 8.1095 |

TABLE 1-continued

| PRESSURE SIDE | | | SUCTION SIDE | | |
|---|---|---|---|---|---|
| X | Y | Z | X | Y | Z |
| −1.1673 | 1.839 | 8.1095 | 1.7706 | −2.5968 | 8.1095 |
| −1.1388 | 1.805 | 8.1095 | 1.7399 | −2.5649 | 8.1095 |
| −1.1062 | 1.7604 | 8.1095 | 1.7035 | −2.5269 | 8.1095 |
| −1.0664 | 1.7005 | 8.1095 | 1.6609 | −2.4824 | 8.1095 |
| −1.0217 | 1.6304 | 8.1095 | 1.6108 | −2.4296 | 8.1095 |
| −0.9743 | 1.5555 | 8.1095 | 1.5531 | −2.3686 | 8.1095 |
| −0.9213 | 1.471 | 8.1095 | 1.4879 | −2.2992 | 8.1095 |
| −0.8624 | 1.3772 | 8.1095 | 1.4155 | −2.2214 | 8.1095 |
| −0.7977 | 1.2739 | 8.1095 | 1.3357 | −2.135 | 8.1095 |
| −0.7299 | 1.166 | 8.1095 | 1.2489 | −2.0399 | 8.1095 |
| −0.6589 | 1.0535 | 8.1095 | 1.159 | −1.9401 | 8.1095 |
| −0.5848 | 0.9366 | 8.1095 | 1.066 | −1.8357 | 8.1095 |
| −0.5073 | 0.8151 | 8.1095 | 0.9702 | −1.7263 | 8.1095 |
| −0.4264 | 0.6893 | 8.1095 | 0.8717 | −1.6121 | 8.1095 |
| −0.342 | 0.5591 | 8.1095 | 0.7707 | −1.4927 | 8.1095 |
| −0.2541 | 0.4247 | 8.1095 | 0.6673 | −1.368 | 8.1095 |
| −0.1626 | 0.286 | 8.1095 | 0.562 | −1.2379 | 8.1095 |
| −0.0705 | 0.1476 | 8.1095 | 0.4583 | −1.1066 | 8.1095 |
| 0.0223 | 0.0097 | 8.1095 | 0.3564 | −0.9738 | 8.1095 |
| 0.1157 | −0.1278 | 8.1095 | 0.2566 | −0.8394 | 8.1095 |
| 0.2098 | −0.2648 | 8.1095 | 0.1589 | −0.7036 | 8.1095 |
| 0.3045 | −0.4014 | 8.1095 | 0.0629 | −0.5663 | 8.1095 |
| 0.3996 | −0.5377 | 8.1095 | −0.0315 | −0.4278 | 8.1095 |
| 0.4948 | −0.6739 | 8.1095 | −0.1246 | −0.2884 | 8.1095 |
| 0.5897 | −0.8104 | 8.1095 | −0.2164 | −0.1479 | 8.1095 |
| 0.6844 | −0.947 | 8.1095 | −0.3068 | −0.0064 | 8.1095 |
| 0.779 | −1.0836 | 8.1095 | −0.3958 | 0.1361 | 8.1095 |
| 0.8737 | −1.2202 | 8.1095 | −0.4831 | 0.2796 | 8.1095 |
| 0.9655 | −1.3522 | 8.1095 | −0.566 | 0.4193 | 8.1095 |
| 1.0543 | −1.4794 | 8.1095 | −0.6445 | 0.555 | 8.1095 |
| 1.1402 | −1.6018 | 8.1095 | −0.7188 | 0.6868 | 8.1095 |
| 1.2232 | −1.7195 | 8.1095 | −0.7889 | 0.8144 | 8.1095 |
| 1.3034 | −1.8325 | 8.1095 | −0.855 | 0.9379 | 8.1095 |
| 1.3807 | −1.9407 | 8.1095 | −0.917 | 1.0571 | 8.1095 |
| 1.4551 | −2.0441 | 8.1095 | −0.9751 | 1.1721 | 8.1095 |
| 1.5233 | −2.1384 | 8.1095 | −1.0294 | 1.2827 | 8.1095 |
| 1.5853 | −2.2235 | 8.1095 | −1.0776 | 1.3838 | 8.1095 |
| 1.6409 | −2.2995 | 8.1095 | −1.1198 | 1.4754 | 8.1095 |
| 1.6902 | −2.3664 | 8.1095 | −1.1564 | 1.5572 | 8.1095 |
| 1.733 | −2.4244 | 8.1095 | −1.1896 | 1.6344 | 8.1095 |
| 1.7693 | −2.4733 | 8.1095 | −1.2167 | 1.702 | 8.1095 |
| 1.8004 | −2.5151 | 8.1095 | −1.2349 | 1.755 | 8.1095 |
| 1.8266 | −2.5501 | 8.1095 | −1.2463 | 1.7983 | 8.1095 |
| 1.8483 | −2.5789 | 8.1095 | −1.2517 | 1.8314 | 8.1095 |
| 1.8657 | −2.6019 | 8.1095 | −1.2523 | 1.8566 | 8.1095 |
| 1.8791 | −2.6195 | 8.1095 | −1.2498 | 1.8704 | 8.1095 |
| 1.8867 | −2.6342 | 8.1095 | −1.2459 | 1.8784 | 8.1095 |
| 1.8867 | −2.6482 | 8.1095 | −1.2429 | 1.8817 | 8.1095 |
| 1.8822 | −2.6585 | 8.1095 | −1.241 | 1.883 | 8.1095 |
| −1.2265 | 1.8532 | 8.8639 | 1.8773 | −2.6897 | 8.8639 |
| −1.2255 | 1.8536 | 8.8639 | 1.8703 | −2.6944 | 8.8639 |
| −1.2234 | 1.8543 | 8.8639 | 1.8595 | −2.6973 | 8.8639 |
| −1.2189 | 1.8547 | 8.8639 | 1.8458 | −2.695 | 8.8639 |
| −1.2102 | 1.8527 | 8.8639 | 1.8325 | −2.685 | 8.8639 |
| −1.1978 | 1.8463 | 8.8639 | 1.8167 | −2.6691 | 8.8639 |
| −1.1783 | 1.8307 | 8.8639 | 1.7962 | −2.6485 | 8.8639 |
| −1.1551 | 1.8068 | 8.8639 | 1.7706 | −2.6227 | 8.8639 |
| −1.1272 | 1.7725 | 8.8639 | 1.7395 | −2.5913 | 8.8639 |
| −1.095 | 1.7277 | 8.8639 | 1.7026 | −2.5539 | 8.8639 |
| −1.0556 | 1.6677 | 8.8639 | 1.6595 | −2.51 | 8.8639 |
| −1.0113 | 1.5976 | 8.8639 | 1.6088 | −2.4579 | 8.8639 |
| −0.9643 | 1.5226 | 8.8639 | 1.5504 | −2.3977 | 8.8639 |
| −0.9117 | 1.4382 | 8.8639 | 1.4845 | −2.3291 | 8.8639 |
| −0.8533 | 1.3443 | 8.8639 | 1.4113 | −2.2522 | 8.8639 |
| −0.789 | 1.2411 | 8.8639 | 1.3308 | −2.1667 | 8.8639 |
| −0.7217 | 1.1332 | 8.8639 | 1.2432 | −2.0724 | 8.8639 |
| −0.6511 | 1.0209 | 8.8639 | 1.1526 | −1.9735 | 8.8639 |
| −0.5773 | 0.904 | 8.8639 | 1.0591 | −1.8697 | 8.8639 |
| −0.5002 | 0.7827 | 8.8639 | 0.9629 | −1.7611 | 8.8639 |
| −0.4197 | 0.6571 | 8.8639 | 0.8641 | −1.6473 | 8.8639 |
| −0.3357 | 0.527 | 8.8639 | 0.763 | −1.5284 | 8.8639 |
| −0.2482 | 0.3927 | 8.8639 | 0.6598 | −1.404 | 8.8639 |
| −0.1572 | 0.2541 | 8.8639 | 0.5548 | −1.274 | 8.8639 |
| −0.0655 | 0.1159 | 8.8639 | 0.4516 | −1.1427 | 8.8639 |
| 0.0267 | −0.0219 | 8.8639 | 0.3503 | −1.0098 | 8.8639 |
| 0.1195 | −0.1592 | 8.8639 | 0.2512 | −0.8753 | 8.8639 |

TABLE 1-continued

| PRESSURE SIDE | | | SUCTION SIDE | | |
|---|---|---|---|---|---|
| X | Y | Z | X | Y | Z |
| 0.213 | −0.2962 | 8.8639 | 0.1543 | −0.7392 | 8.8639 |
| 0.3072 | −0.4326 | 8.8639 | 0.0592 | −0.6016 | 8.8639 |
| 0.4019 | −0.5687 | 8.8639 | −0.0344 | −0.463 | 8.8639 |
| 0.4968 | −0.7046 | 8.8639 | −0.1267 | −0.3232 | 8.8639 |
| 0.5916 | −0.8406 | 8.8639 | −0.2176 | −0.1825 | 8.8639 |
| 0.6862 | −0.9768 | 8.8639 | −0.3071 | −0.0407 | 8.8639 |
| 0.7807 | −1.113 | 8.8639 | −0.3952 | 0.1021 | 8.8639 |
| 0.8753 | −1.2491 | 8.8639 | −0.4816 | 0.2459 | 8.8639 |
| 0.9668 | −1.3807 | 8.8639 | −0.5635 | 0.3858 | 8.8639 |
| 1.0553 | −1.5076 | 8.8639 | −0.6412 | 0.5218 | 8.8639 |
| 1.141 | −1.6298 | 8.8639 | −0.7145 | 0.6538 | 8.8639 |
| 1.2238 | −1.7472 | 8.8639 | −0.7837 | 0.7817 | 8.8639 |
| 1.3037 | −1.8599 | 8.8639 | −0.8488 | 0.9054 | 8.8639 |
| 1.3808 | −1.9679 | 8.8639 | −0.91 | 1.0249 | 8.8639 |
| 1.455 | −2.0711 | 8.8639 | −0.9671 | 1.1402 | 8.8639 |
| 1.523 | −2.1651 | 8.8639 | −1.0204 | 1.2511 | 8.8639 |
| 1.5849 | −2.25 | 8.8639 | −1.0676 | 1.3525 | 8.8639 |
| 1.6405 | −2.3257 | 8.8639 | −1.1089 | 1.4443 | 8.8639 |
| 1.6897 | −2.3925 | 8.8639 | −1.1446 | 1.5264 | 8.8639 |
| 1.7325 | −2.4502 | 8.8639 | −1.177 | 1.6038 | 8.8639 |
| 1.7688 | −2.4989 | 8.8639 | −1.2032 | 1.6715 | 8.8639 |
| 1.8 | −2.5405 | 8.8639 | −1.2209 | 1.7246 | 8.8639 |
| 1.8262 | −2.5754 | 8.8639 | −1.2322 | 1.7679 | 8.8639 |
| 1.8479 | −2.6041 | 8.8639 | −1.2376 | 1.801 | 8.8639 |
| 1.8652 | −2.627 | 8.8639 | −1.2384 | 1.8261 | 8.8639 |
| 1.8785 | −2.6446 | 8.8639 | −1.2361 | 1.8399 | 8.8639 |
| 1.8866 | −2.659 | 8.8639 | −1.2324 | 1.848 | 8.8639 |
| 1.887 | −2.6729 | 8.8639 | −1.2294 | 1.8513 | 8.8639 |
| 1.8828 | −2.6833 | 8.8639 | −1.2275 | 1.8526 | 8.8639 |
| −1.2066 | 1.8351 | 9.6184 | 1.8608 | −2.714 | 9.6184 |
| −1.2056 | 1.8355 | 9.6184 | 1.8538 | −2.7187 | 9.6184 |
| −1.2034 | 1.8361 | 9.6184 | 1.843 | −2.7214 | 9.6184 |
| −1.1989 | 1.8363 | 9.6184 | 1.8294 | −2.7189 | 9.6184 |
| −1.1903 | 1.834 | 9.6184 | 1.8163 | −2.7085 | 9.6184 |
| −1.1783 | 1.8271 | 9.6184 | 1.8004 | −2.6929 | 9.6184 |
| −1.1593 | 1.811 | 9.6184 | 1.7798 | −2.6725 | 9.6184 |
| −1.1368 | 1.7866 | 9.6184 | 1.7541 | −2.647 | 9.6184 |
| −1.1097 | 1.7519 | 9.6184 | 1.7229 | −2.6159 | 9.6184 |
| −1.0783 | 1.7068 | 9.6184 | 1.6858 | −2.5788 | 9.6184 |
| −1.0395 | 1.6465 | 9.6184 | 1.6426 | −2.5353 | 9.6184 |
| −0.9959 | 1.5763 | 9.6184 | 1.5917 | −2.4836 | 9.6184 |
| −0.9496 | 1.5013 | 9.6184 | 1.5332 | −2.4238 | 9.6184 |
| −0.8976 | 1.4168 | 9.6184 | 1.4673 | −2.3558 | 9.6184 |
| −0.8398 | 1.3229 | 9.6184 | 1.394 | −2.2792 | 9.6184 |
| −0.7761 | 1.2198 | 9.6184 | 1.3135 | −2.1942 | 9.6184 |
| −0.7093 | 1.112 | 9.6184 | 1.2261 | −2.1003 | 9.6184 |
| −0.6394 | 0.9998 | 9.6184 | 1.1357 | −2.0018 | 9.6184 |
| −0.5663 | 0.883 | 9.6184 | 1.0426 | −1.8983 | 9.6184 |
| −0.4898 | 0.7619 | 9.6184 | 0.9469 | −1.7899 | 9.6184 |
| −0.4101 | 0.6363 | 9.6184 | 0.8487 | −1.6762 | 9.6184 |
| −0.327 | 0.5062 | 9.6184 | 0.7484 | −1.5572 | 9.6184 |
| −0.2406 | 0.3718 | 9.6184 | 0.6461 | −1.4328 | 9.6184 |
| −0.1508 | 0.233 | 9.6184 | 0.5421 | −1.3025 | 9.6184 |
| −0.0604 | 0.0946 | 9.6184 | 0.4402 | −1.1707 | 9.6184 |
| 0.0305 | −0.0435 | 9.6184 | 0.3405 | −1.0371 | 9.6184 |
| 0.122 | −0.1812 | 9.6184 | 0.2431 | −0.9017 | 9.6184 |
| 0.2142 | −0.3184 | 9.6184 | 0.1479 | −0.7646 | 9.6184 |
| 0.307 | −0.4552 | 9.6184 | 0.0543 | −0.6262 | 9.6184 |
| 0.4005 | −0.5916 | 9.6184 | −0.0379 | −0.4868 | 9.6184 |
| 0.4942 | −0.7278 | 9.6184 | −0.1287 | −0.3463 | 9.6184 |
| 0.5881 | −0.8639 | 9.6184 | −0.2181 | −0.2048 | 9.6184 |
| 0.6819 | −1 | 9.6184 | −0.3059 | −0.0625 | 9.6184 |
| 0.7757 | −1.1361 | 9.6184 | −0.3922 | 0.0809 | 9.6184 |
| 0.8696 | −1.2722 | 9.6184 | −0.477 | 0.2251 | 9.6184 |
| 0.9602 | −1.4038 | 9.6184 | −0.5575 | 0.3654 | 9.6184 |
| 1.0477 | −1.5309 | 9.6184 | −0.6338 | 0.5017 | 9.6184 |
| 1.1322 | −1.6533 | 9.6184 | −0.7059 | 0.6339 | 9.6184 |
| 1.2139 | −1.771 | 9.6184 | −0.7739 | 0.762 | 9.6184 |
| 1.2928 | −1.884 | 9.6184 | −0.8378 | 0.8859 | 9.6184 |
| 1.3688 | −1.9922 | 9.6184 | −0.8978 | 1.0056 | 9.6184 |
| 1.442 | −2.0957 | 9.6184 | −0.9538 | 1.121 | 9.6184 |
| 1.5093 | −2.1899 | 9.6184 | −1.0059 | 1.2322 | 9.6184 |
| 1.5703 | −2.2749 | 9.6184 | −1.052 | 1.3338 | 9.6184 |
| 1.6252 | −2.3508 | 9.6184 | −1.0922 | 1.4258 | 9.6184 |
| 1.6739 | −2.4176 | 9.6184 | −1.1268 | 1.508 | 9.6184 |
| 1.7163 | −2.4754 | 9.6184 | −1.1581 | 1.5857 | 9.6184 |

TABLE 1-continued

| PRESSURE SIDE | | | SUCTION SIDE | | |
|---|---|---|---|---|---|
| X | Y | Z | X | Y | Z |
| 1.7523 | −2.5241 | 9.6184 | −1.1835 | 1.6536 | 9.6184 |
| 1.7833 | −2.5657 | 9.6184 | −1.2007 | 1.7066 | 9.6184 |
| 1.8093 | −2.6005 | 9.6184 | −1.2117 | 1.7499 | 9.6184 |
| 1.8308 | −2.6292 | 9.6184 | −1.2171 | 1.7829 | 9.6184 |
| 1.8481 | −2.6521 | 9.6184 | −1.218 | 1.808 | 9.6184 |
| 1.8613 | −2.6697 | 9.6184 | −1.2159 | 1.8217 | 9.6184 |
| 1.8695 | −2.6839 | 9.6184 | −1.2124 | 1.8299 | 9.6184 |
| 1.8701 | −2.6975 | 9.6184 | −1.2094 | 1.8332 | 9.6184 |
| 1.8661 | −2.7077 | 9.6184 | −1.2076 | 1.8345 | 9.6184 |
| −1.148 | 1.8547 | 10.3728 | 1.7725 | −2.7568 | 10.3728 |
| −1.147 | 1.8551 | 10.3728 | 1.7656 | −2.7615 | 10.3728 |
| −1.1448 | 1.8556 | 10.3728 | 1.7548 | −2.764 | 10.3728 |
| −1.1404 | 1.8556 | 10.3728 | 1.7414 | −2.7608 | 10.3728 |
| −1.132 | 1.8527 | 10.3728 | 1.7289 | −2.7498 | 10.3728 |
| −1.1204 | 1.8452 | 10.3728 | 1.7132 | −2.7341 | 10.3728 |
| −1.1023 | 1.8283 | 10.3728 | 1.6929 | −2.7137 | 10.3728 |
| −1.081 | 1.8031 | 10.3728 | 1.6675 | −2.6881 | 10.3728 |
| −1.0553 | 1.7677 | 10.3728 | 1.6367 | −2.6568 | 10.3728 |
| −1.0255 | 1.7218 | 10.3728 | 1.6002 | −2.6195 | 10.3728 |
| −0.9886 | 1.6609 | 10.3728 | 1.5578 | −2.5757 | 10.3728 |
| −0.9467 | 1.5902 | 10.3728 | 1.5079 | −2.5236 | 10.3728 |
| −0.9022 | 1.5147 | 10.3728 | 1.4506 | −2.4632 | 10.3728 |
| −0.8521 | 1.4297 | 10.3728 | 1.3862 | −2.3943 | 10.3728 |
| −0.7965 | 1.3352 | 10.3728 | 1.3149 | −2.3167 | 10.3728 |
| −0.7354 | 1.2313 | 10.3728 | 1.2368 | −2.2302 | 10.3728 |
| −0.6714 | 1.1227 | 10.3728 | 1.1522 | −2.1347 | 10.3728 |
| −0.6045 | 1.0094 | 10.3728 | 1.0651 | −2.0342 | 10.3728 |
| −0.5347 | 0.8916 | 10.3728 | 0.9756 | −1.9286 | 10.3728 |
| −0.4618 | 0.7691 | 10.3728 | 0.8838 | −1.8179 | 10.3728 |
| −0.3858 | 0.6422 | 10.3728 | 0.79 | −1.7018 | 10.3728 |
| −0.3067 | 0.5107 | 10.3728 | 0.6942 | −1.5802 | 10.3728 |
| −0.2244 | 0.3747 | 10.3728 | 0.597 | −1.4529 | 10.3728 |
| −0.139 | 0.2343 | 10.3728 | 0.4985 | −1.3196 | 10.3728 |
| −0.0532 | 0.0941 | 10.3728 | 0.4024 | −1.1846 | 10.3728 |
| 0.033 | −0.046 | 10.3728 | 0.3086 | −1.0478 | 10.3728 |
| 0.1194 | −0.1858 | 10.3728 | 0.2172 | −0.9093 | 10.3728 |
| 0.2063 | −0.3254 | 10.3728 | 0.1278 | −0.7694 | 10.3728 |
| 0.2936 | −0.4647 | 10.3728 | 0.04 | −0.6282 | 10.3728 |
| 0.3817 | −0.6035 | 10.3728 | −0.0465 | −0.4861 | 10.3728 |
| 0.4702 | −0.742 | 10.3728 | −0.1318 | −0.3432 | 10.3728 |
| 0.559 | −0.8804 | 10.3728 | −0.2159 | −0.1996 | 10.3728 |
| 0.648 | −1.0186 | 10.3728 | −0.2987 | −0.0553 | 10.3728 |
| 0.7372 | −1.1567 | 10.3728 | −0.3802 | 0.0897 | 10.3728 |
| 0.8263 | −1.2948 | 10.3728 | −0.4603 | 0.2355 | 10.3728 |
| 0.9123 | −1.4285 | 10.3728 | −0.5365 | 0.3773 | 10.3728 |
| 0.9953 | −1.5575 | 10.3728 | −0.6085 | 0.5148 | 10.3728 |
| 1.0755 | −1.6819 | 10.3728 | −0.6767 | 0.6482 | 10.3728 |
| 1.1528 | −1.8015 | 10.3728 | −0.7409 | 0.7774 | 10.3728 |
| 1.2276 | −1.9163 | 10.3728 | −0.8012 | 0.9022 | 10.3728 |
| 1.2997 | −2.0263 | 10.3728 | −0.8577 | 1.0228 | 10.3728 |
| 1.3693 | −2.1314 | 10.3728 | −0.9106 | 1.1389 | 10.3728 |
| 1.4333 | −2.227 | 10.3728 | −0.9598 | 1.2506 | 10.3728 |
| 1.4916 | −2.3133 | 10.3728 | −1.0032 | 1.3527 | 10.3728 |
| 1.5441 | −2.3902 | 10.3728 | −1.0411 | 1.4451 | 10.3728 |
| 1.5908 | −2.4579 | 10.3728 | −1.0736 | 1.5277 | 10.3728 |
| 1.6316 | −2.5163 | 10.3728 | −1.1029 | 1.6056 | 10.3728 |
| 1.6663 | −2.5656 | 10.3728 | −1.1267 | 1.6736 | 10.3728 |
| 1.6961 | −2.6076 | 10.3728 | −1.1429 | 1.7267 | 10.3728 |
| 1.7214 | −2.6427 | 10.3728 | −1.1533 | 1.7698 | 10.3728 |
| 1.7422 | −2.6716 | 10.3728 | −1.1583 | 1.8027 | 10.3728 |
| 1.7589 | −2.6947 | 10.3728 | −1.1591 | 1.8277 | 10.3728 |
| 1.7718 | −2.7125 | 10.3728 | −1.1571 | 1.8414 | 10.3728 |
| 1.7803 | −2.7265 | 10.3728 | −1.1537 | 1.8495 | 10.3728 |
| 1.7814 | −2.7401 | 10.3728 | −1.1508 | 1.8529 | 10.3728 |
| 1.7777 | −2.7504 | 10.3728 | −1.149 | 1.8542 | 10.3728 |
| −1.0747 | 1.9097 | 10.7501 | 1.6857 | −2.7752 | 10.7501 |
| −1.0737 | 1.9101 | 10.7501 | 1.6788 | −2.7799 | 10.7501 |
| −1.0715 | 1.9105 | 10.7501 | 1.668 | −2.7823 | 10.7501 |
| −1.0671 | 1.9103 | 10.7501 | 1.6548 | −2.7787 | 10.7501 |
| −1.0589 | 1.9072 | 10.7501 | 1.6425 | −2.7675 | 10.7501 |
| −1.0477 | 1.8991 | 10.7501 | 1.6269 | −2.7518 | 10.7501 |
| −1.0304 | 1.8816 | 10.7501 | 1.6066 | −2.7314 | 10.7501 |
| −1.0102 | 1.8558 | 10.7501 | 1.5813 | −2.7059 | 10.7501 |
| −0.9859 | 1.8195 | 10.7501 | 1.5507 | −2.6746 | 10.7501 |
| −0.9579 | 1.7728 | 10.7501 | 1.5146 | −2.6372 | 10.7501 |
| −0.9231 | 1.711 | 10.7501 | 1.4726 | −2.5933 | 10.7501 |

TABLE 1-continued

| PRESSURE SIDE | | | SUCTION SIDE | | |
|---|---|---|---|---|---|
| X | Y | Z | X | Y | Z |
| −0.8835 | 1.6393 | 10.7501 | 1.4232 | −2.5409 | 10.7501 |
| −0.8415 | 1.5627 | 10.7501 | 1.3668 | −2.4801 | 10.7501 |
| −0.7943 | 1.4766 | 10.7501 | 1.3036 | −2.4106 | 10.7501 |
| −0.7419 | 1.3808 | 10.7501 | 1.2337 | −2.332 | 10.7501 |
| −0.6842 | 1.2755 | 10.7501 | 1.1576 | −2.2444 | 10.7501 |
| −0.6238 | 1.1654 | 10.7501 | 1.0755 | −2.1474 | 10.7501 |
| −0.5608 | 1.0506 | 10.7501 | 0.9913 | −2.0452 | 10.7501 |
| −0.495 | 0.931 | 10.7501 | 0.9051 | −1.9377 | 10.7501 |
| −0.4266 | 0.8067 | 10.7501 | 0.8172 | −1.8246 | 10.7501 |
| −0.3553 | 0.6777 | 10.7501 | 0.7278 | −1.7059 | 10.7501 |
| −0.2813 | 0.544 | 10.7501 | 0.637 | −1.5813 | 10.7501 |
| −0.2045 | 0.4056 | 10.7501 | 0.5452 | −1.4507 | 10.7501 |
| −0.1246 | 0.2626 | 10.7501 | 0.4527 | −1.3139 | 10.7501 |
| −0.0445 | 0.1198 | 10.7501 | 0.3628 | −1.1752 | 10.7501 |
| 0.036 | −0.0227 | 10.7501 | 0.2753 | −1.0347 | 10.7501 |
| 0.1168 | −0.1652 | 10.7501 | 0.1899 | −0.8928 | 10.7501 |
| 0.1979 | −0.3074 | 10.7501 | 0.1064 | −0.7495 | 10.7501 |
| 0.2796 | −0.4493 | 10.7501 | 0.0245 | −0.6053 | 10.7501 |
| 0.362 | −0.5908 | 10.7501 | −0.0562 | −0.4604 | 10.7501 |
| 0.445 | −0.732 | 10.7501 | −0.1356 | −0.3148 | 10.7501 |
| 0.5285 | −0.8729 | 10.7501 | −0.2138 | −0.1686 | 10.7501 |
| 0.6122 | −1.0137 | 10.7501 | −0.2908 | −0.0217 | 10.7501 |
| 0.6961 | −1.1543 | 10.7501 | −0.3666 | 0.1259 | 10.7501 |
| 0.78 | −1.295 | 10.7501 | −0.441 | 0.2741 | 10.7501 |
| 0.8611 | −1.431 | 10.7501 | −0.5117 | 0.418 | 10.7501 |
| 0.9394 | −1.5622 | 10.7501 | −0.5786 | 0.5576 | 10.7501 |
| 1.0152 | −1.6886 | 10.7501 | −0.6419 | 0.6928 | 10.7501 |
| 1.0886 | −1.8101 | 10.7501 | −0.7016 | 0.8236 | 10.7501 |
| 1.1596 | −1.9267 | 10.7501 | −0.7576 | 0.95 | 10.7501 |
| 1.2284 | −2.0382 | 10.7501 | −0.8101 | 1.0718 | 10.7501 |
| 1.295 | −2.1446 | 10.7501 | −0.8592 | 1.1892 | 10.7501 |
| 1.3564 | −2.2415 | 10.7501 | −0.9046 | 1.302 | 10.7501 |
| 1.4125 | −2.3287 | 10.7501 | −0.9447 | 1.4051 | 10.7501 |
| 1.4632 | −2.4064 | 10.7501 | −0.9795 | 1.4983 | 10.7501 |
| 1.5084 | −2.4747 | 10.7501 | −1.0093 | 1.5816 | 10.7501 |
| 1.5479 | −2.5337 | 10.7501 | −1.036 | 1.6601 | 10.7501 |
| 1.5816 | −2.5834 | 10.7501 | −1.0578 | 1.7286 | 10.7501 |
| 1.6107 | −2.6257 | 10.7501 | −1.0725 | 1.7819 | 10.7501 |
| 1.6353 | −2.6611 | 10.7501 | −1.0817 | 1.8252 | 10.7501 |
| 1.6557 | −2.6902 | 10.7501 | −1.086 | 1.8581 | 10.7501 |
| 1.672 | −2.7134 | 10.7501 | −1.0863 | 1.883 | 10.7501 |
| 1.6846 | −2.7312 | 10.7501 | −1.084 | 1.8966 | 10.7501 |
| 1.6931 | −2.7451 | 10.7501 | −1.0805 | 1.9047 | 10.7501 |
| 1.6944 | −2.7586 | 10.7501 | −1.0776 | 1.908 | 10.7501 |
| 1.6908 | −2.7688 | 10.7501 | −1.0757 | 1.9092 | 10.7501 |
| −0.9644 | 2.0022 | 11.1274 | 1.5913 | −2.788 | 11.1274 |
| −0.9633 | 2.0026 | 11.1274 | 1.5844 | −2.7927 | 11.1274 |
| −0.9611 | 2.0029 | 11.1274 | 1.5735 | −2.795 | 11.1274 |
| −0.9567 | 2.0024 | 11.1274 | 1.5604 | −2.7908 | 11.1274 |
| −0.9488 | 1.9986 | 11.1274 | 1.5482 | −2.7794 | 11.1274 |
| −0.9382 | 1.9898 | 11.1274 | 1.5324 | −2.7638 | 11.1274 |
| −0.9222 | 1.9711 | 11.1274 | 1.512 | −2.7434 | 11.1274 |
| −0.9037 | 1.9441 | 11.1274 | 1.4867 | −2.7179 | 11.1274 |
| −0.8818 | 1.9065 | 11.1274 | 1.456 | −2.6866 | 11.1274 |
| −0.8568 | 1.8581 | 11.1274 | 1.4198 | −2.6491 | 11.1274 |
| −0.8257 | 1.7945 | 11.1274 | 1.3779 | −2.6048 | 11.1274 |
| −0.7901 | 1.7208 | 11.1274 | 1.3288 | −2.552 | 11.1274 |
| −0.7524 | 1.6422 | 11.1274 | 1.2729 | −2.4905 | 11.1274 |
| −0.7099 | 1.5538 | 11.1274 | 1.2104 | −2.4201 | 11.1274 |
| −0.6627 | 1.4556 | 11.1274 | 1.1417 | −2.3403 | 11.1274 |
| −0.6106 | 1.3476 | 11.1274 | 1.067 | −2.251 | 11.1274 |
| −0.556 | 1.2347 | 11.1274 | 0.9871 | −2.1521 | 11.1274 |
| −0.4989 | 1.117 | 11.1274 | 0.9056 | −2.0476 | 11.1274 |
| −0.4393 | 0.9945 | 11.1274 | 0.8228 | −1.9374 | 11.1274 |
| −0.3772 | 0.8671 | 11.1274 | 0.739 | −1.8213 | 11.1274 |
| −0.3127 | 0.7348 | 11.1274 | 0.6543 | −1.6992 | 11.1274 |
| −0.2457 | 0.5977 | 11.1274 | 0.5691 | −1.5709 | 11.1274 |
| −0.176 | 0.4559 | 11.1274 | 0.4836 | −1.4362 | 11.1274 |
| −0.1035 | 0.3093 | 11.1274 | 0.3982 | −1.2949 | 11.1274 |
| −0.0305 | 0.163 | 11.1274 | 0.3157 | −1.1518 | 11.1274 |
| 0.0429 | 0.0169 | 11.1274 | 0.2357 | −1.007 | 11.1274 |
| 0.1168 | −0.129 | 11.1274 | 0.1578 | −0.8609 | 11.1274 |
| 0.1911 | −0.2746 | 11.1274 | 0.0815 | −0.7137 | 11.1274 |
| 0.266 | −0.4199 | 11.1274 | 0.0066 | −0.5656 | 11.1274 |
| 0.3416 | −0.5649 | 11.1274 | −0.0669 | −0.417 | 11.1274 |
| 0.4178 | −0.7095 | 11.1274 | −0.139 | −0.2676 | 11.1274 |

TABLE 1-continued

| PRESSURE SIDE | | | SUCTION SIDE | | |
|---|---|---|---|---|---|
| X | Y | Z | X | Y | Z |
| 0.4948 | −0.8538 | 11.1274 | −0.2099 | −0.1177 | 11.1274 |
| 0.5723 | −0.9977 | 11.1274 | −0.2794 | 0.0329 | 11.1274 |
| 0.6501 | −1.1415 | 11.1274 | −0.3475 | 0.1841 | 11.1274 |
| 0.728 | −1.2853 | 11.1274 | −0.4142 | 0.336 | 11.1274 |
| 0.8034 | −1.4242 | 11.1274 | −0.4772 | 0.4835 | 11.1274 |
| 0.8765 | −1.5581 | 11.1274 | −0.5368 | 0.6264 | 11.1274 |
| 0.9475 | −1.687 | 11.1274 | −0.593 | 0.7647 | 11.1274 |
| 1.0166 | −1.8107 | 11.1274 | −0.646 | 0.8983 | 11.1274 |
| 1.0837 | −1.9293 | 11.1274 | −0.6955 | 1.0273 | 11.1274 |
| 1.1489 | −2.0427 | 11.1274 | −0.7418 | 1.1517 | 11.1274 |
| 1.2124 | −2.1508 | 11.1274 | −0.7849 | 1.2714 | 11.1274 |
| 1.2712 | −2.249 | 11.1274 | −0.8245 | 1.3864 | 11.1274 |
| 1.3251 | −2.3374 | 11.1274 | −0.8592 | 1.4914 | 11.1274 |
| 1.3741 | −2.4161 | 11.1274 | −0.8892 | 1.5863 | 11.1274 |
| 1.4179 | −2.4851 | 11.1274 | −0.9147 | 1.6711 | 11.1274 |
| 1.4563 | −2.5447 | 11.1274 | −0.9373 | 1.7509 | 11.1274 |
| 1.4891 | −2.5948 | 11.1274 | −0.9556 | 1.8204 | 11.1274 |
| 1.5175 | −2.6375 | 11.1274 | −0.9677 | 1.8743 | 11.1274 |
| 1.5415 | −2.6732 | 11.1274 | −0.9749 | 1.918 | 11.1274 |
| 1.5614 | −2.7026 | 11.1274 | −0.9777 | 1.951 | 11.1274 |
| 1.5774 | −2.726 | 11.1274 | −0.9768 | 1.9759 | 11.1274 |
| 1.5897 | −2.744 | 11.1274 | −0.9741 | 1.9894 | 11.1274 |
| 1.5983 | −2.7578 | 11.1274 | −0.9703 | 1.9974 | 11.1274 |
| 1.5999 | −2.7713 | 11.1274 | −0.9673 | 2.0006 | 11.1274 |
| 1.5964 | −2.7816 | 11.1274 | −0.9654 | 2.0018 | 11.1274 |
| −0.8318 | 2.1118 | 11.5045 | 1.4961 | −2.7992 | 11.5045 |
| −0.8307 | 2.1121 | 11.5045 | 1.4891 | −2.804 | 11.5045 |
| −0.8285 | 2.1122 | 11.5045 | 1.478 | −2.8061 | 11.5045 |
| −0.8242 | 2.1113 | 11.5045 | 1.465 | −2.8014 | 11.5045 |
| −0.8166 | 2.1068 | 11.5045 | 1.4528 | −2.7899 | 11.5045 |
| −0.807 | 2.0971 | 11.5045 | 1.4369 | −2.7742 | 11.5045 |
| −0.7926 | 2.077 | 11.5045 | 1.4163 | −2.7538 | 11.5045 |
| −0.7766 | 2.0485 | 11.5045 | 1.3907 | −2.728 | 11.5045 |
| −0.758 | 2.0092 | 11.5045 | 1.3599 | −2.6965 | 11.5045 |
| −0.7369 | 1.9588 | 11.5045 | 1.3235 | −2.6587 | 11.5045 |
| −0.7109 | 1.8928 | 11.5045 | 1.2816 | −2.6139 | 11.5045 |
| −0.681 | 1.8166 | 11.5045 | 1.2326 | −2.5604 | 11.5045 |
| −0.649 | 1.7354 | 11.5045 | 1.1769 | −2.4979 | 11.5045 |
| −0.6128 | 1.6441 | 11.5045 | 1.115 | −2.4261 | 11.5045 |
| −0.5723 | 1.5428 | 11.5045 | 1.0471 | −2.3447 | 11.5045 |
| −0.5274 | 1.4314 | 11.5045 | 0.9738 | −2.2533 | 11.5045 |
| −0.4802 | 1.3152 | 11.5045 | 0.8958 | −2.1517 | 11.5045 |
| −0.4305 | 1.194 | 11.5045 | 0.817 | −2.0443 | 11.5045 |
| −0.3784 | 1.0679 | 11.5045 | 0.7376 | −1.9308 | 11.5045 |
| −0.3237 | 0.937 | 11.5045 | 0.658 | −1.8111 | 11.5045 |
| −0.2665 | 0.8013 | 11.5045 | 0.5784 | −1.6851 | 11.5045 |
| −0.2066 | 0.6607 | 11.5045 | 0.4991 | −1.5525 | 11.5045 |
| −0.1441 | 0.5153 | 11.5045 | 0.4204 | −1.4133 | 11.5045 |
| −0.0789 | 0.3652 | 11.5045 | 0.3426 | −1.2672 | 11.5045 |
| −0.0131 | 0.2153 | 11.5045 | 0.2682 | −1.1192 | 11.5045 |
| 0.0533 | 0.0657 | 11.5045 | 0.1963 | −0.9697 | 11.5045 |
| 0.1201 | −0.0837 | 11.5045 | 0.1261 | −0.8192 | 11.5045 |
| 0.1874 | −0.2329 | 11.5045 | 0.0575 | −0.6679 | 11.5045 |
| 0.2551 | −0.3819 | 11.5045 | −0.0097 | −0.5157 | 11.5045 |
| 0.3234 | −0.5307 | 11.5045 | −0.0756 | −0.3629 | 11.5045 |
| 0.3923 | −0.6791 | 11.5045 | −0.1401 | −0.2096 | 11.5045 |
| 0.4622 | −0.8271 | 11.5045 | −0.2033 | −0.0556 | 11.5045 |
| 0.533 | −0.9747 | 11.5045 | −0.2651 | 0.0988 | 11.5045 |
| 0.6045 | −1.122 | 11.5045 | −0.3253 | 0.2539 | 11.5045 |
| 0.6761 | −1.2692 | 11.5045 | −0.3839 | 0.4097 | 11.5045 |
| 0.7455 | −1.4114 | 11.5045 | −0.439 | 0.5608 | 11.5045 |
| 0.8131 | −1.5484 | 11.5045 | −0.4906 | 0.7073 | 11.5045 |
| 0.879 | −1.6802 | 11.5045 | −0.5389 | 0.849 | 11.5045 |
| 0.9434 | −1.8066 | 11.5045 | −0.5839 | 0.9861 | 11.5045 |
| 1.0065 | −1.9276 | 11.5045 | −0.6256 | 1.1183 | 11.5045 |
| 1.0681 | −2.0431 | 11.5045 | −0.6641 | 1.2458 | 11.5045 |
| 1.1283 | −2.1533 | 11.5045 | −0.6997 | 1.3683 | 11.5045 |
| 1.1845 | −2.2532 | 11.5045 | −0.7319 | 1.486 | 11.5045 |
| 1.2363 | −2.343 | 11.5045 | −0.7598 | 1.5933 | 11.5045 |
| 1.2836 | −2.4228 | 11.5045 | −0.7836 | 1.6903 | 11.5045 |
| 1.326 | −2.4928 | 11.5045 | −0.8035 | 1.7768 | 11.5045 |
| 1.3634 | −2.5532 | 11.5045 | −0.8208 | 1.8582 | 11.5045 |
| 1.3954 | −2.604 | 11.5045 | −0.8345 | 1.929 | 11.5045 |
| 1.4231 | −2.6472 | 11.5045 | −0.8431 | 1.9838 | 11.5045 |
| 1.4466 | −2.6833 | 11.5045 | −0.8474 | 2.028 | 11.5045 |
| 1.4661 | −2.713 | 11.5045 | −0.8481 | 2.0612 | 11.5045 |

TABLE 1-continued

| PRESSURE SIDE | | | SUCTION SIDE | | |
|---|---|---|---|---|---|
| X | Y | Z | X | Y | Z |
| 1.4818 | −2.7366 | 11.5045 | −0.8457 | 2.0861 | 11.5045 |
| 1.4939 | −2.7548 | 11.5045 | −0.8422 | 2.0995 | 11.5045 |
| 1.5026 | −2.7686 | 11.5045 | −0.838 | 2.1073 | 11.5045 |
| 1.5045 | −2.7822 | 11.5045 | −0.8348 | 2.1103 | 11.5045 |
| 1.5012 | −2.7927 | 11.5045 | −0.8329 | 2.1114 | 11.5045 |
| −0.6928 | 2.2255 | 11.8818 | 1.4012 | −2.8107 | 11.8818 |
| −0.6917 | 2.2256 | 11.8818 | 1.3942 | −2.8155 | 11.8818 |
| −0.6895 | 2.2256 | 11.8818 | 1.3831 | −2.8178 | 11.8818 |
| −0.6853 | 2.2242 | 11.8818 | 1.3699 | −2.8135 | 11.8818 |
| −0.6783 | 2.2188 | 11.8818 | 1.3576 | −2.8019 | 11.8818 |
| −0.6696 | 2.2081 | 11.8818 | 1.3416 | −2.7861 | 11.8818 |
| −0.6573 | 2.1867 | 11.8818 | 1.321 | −2.7654 | 11.8818 |
| −0.644 | 2.1567 | 11.8818 | 1.2953 | −2.7393 | 11.8818 |
| −0.6289 | 2.1156 | 11.8818 | 1.2644 | −2.7075 | 11.8818 |
| −0.6123 | 2.0634 | 11.8818 | 1.2281 | −2.6691 | 11.8818 |
| −0.5919 | 1.9951 | 11.8818 | 1.1862 | −2.6237 | 11.8818 |
| −0.5682 | 1.9164 | 11.8818 | 1.1375 | −2.5693 | 11.8818 |
| −0.5425 | 1.8326 | 11.8818 | 1.0823 | −2.5058 | 11.8818 |
| −0.5131 | 1.7384 | 11.8818 | 1.021 | −2.4326 | 11.8818 |
| −0.4798 | 1.634 | 11.8818 | 0.9541 | −2.3495 | 11.8818 |
| −0.4426 | 1.5193 | 11.8818 | 0.8822 | −2.2559 | 11.8818 |
| −0.4031 | 1.3997 | 11.8818 | 0.8062 | −2.1519 | 11.8818 |
| −0.3613 | 1.275 | 11.8818 | 0.73 | −2.0417 | 11.8818 |
| −0.3169 | 1.1454 | 11.8818 | 0.6538 | −1.9252 | 11.8818 |
| −0.2699 | 1.0109 | 11.8818 | 0.5782 | −1.8021 | 11.8818 |
| −0.22 | 0.8716 | 11.8818 | 0.5033 | −1.6722 | 11.8818 |
| −0.1675 | 0.7275 | 11.8818 | 0.4297 | −1.5355 | 11.8818 |
| −0.1122 | 0.5785 | 11.8818 | 0.3574 | −1.3917 | 11.8818 |
| −0.0542 | 0.4247 | 11.8818 | 0.287 | −1.2406 | 11.8818 |
| 0.0044 | 0.2711 | 11.8818 | 0.2204 | −1.0875 | 11.8818 |
| 0.0636 | 0.1178 | 11.8818 | 0.1566 | −0.9328 | 11.8818 |
| 0.1232 | −0.0354 | 11.8818 | 0.0944 | −0.7773 | 11.8818 |
| 0.1834 | −0.1884 | 11.8818 | 0.0337 | −0.6211 | 11.8818 |
| 0.2439 | −0.3412 | 11.8818 | −0.0257 | −0.4644 | 11.8818 |
| 0.3048 | −0.4938 | 11.8818 | −0.0836 | −0.3072 | 11.8818 |
| 0.3665 | −0.6462 | 11.8818 | −0.1403 | −0.1496 | 11.8818 |
| 0.4293 | −0.7982 | 11.8818 | −0.1957 | 0.0086 | 11.8818 |
| 0.4934 | −0.9495 | 11.8818 | −0.2496 | 0.1672 | 11.8818 |
| 0.5582 | −1.1006 | 11.8818 | −0.302 | 0.3264 | 11.8818 |
| 0.6234 | −1.2515 | 11.8818 | −0.3526 | 0.4862 | 11.8818 |
| 0.6868 | −1.3972 | 11.8818 | −0.3997 | 0.6411 | 11.8818 |
| 0.7488 | −1.5375 | 11.8818 | −0.4433 | 0.7913 | 11.8818 |
| 0.8096 | −1.6724 | 11.8818 | −0.4835 | 0.9367 | 11.8818 |
| 0.8694 | −1.8017 | 11.8818 | −0.5204 | 1.0772 | 11.8818 |
| 0.9284 | −1.9254 | 11.8818 | −0.5538 | 1.2128 | 11.8818 |
| 0.9864 | −2.0434 | 11.8818 | −0.5841 | 1.3434 | 11.8818 |
| 1.0435 | −2.1558 | 11.8818 | −0.6117 | 1.4689 | 11.8818 |
| 1.0971 | −2.2576 | 11.8818 | −0.6361 | 1.5894 | 11.8818 |
| 1.1469 | −2.3491 | 11.8818 | −0.6568 | 1.6992 | 11.8818 |
| 1.1927 | −2.4302 | 11.8818 | −0.674 | 1.7983 | 11.8818 |
| 1.234 | −2.5013 | 11.8818 | −0.6878 | 1.8866 | 11.8818 |
| 1.2705 | −2.5625 | 11.8818 | −0.6995 | 1.9696 | 11.8818 |
| 1.302 | −2.614 | 11.8818 | −0.7081 | 2.0417 | 11.8818 |
| 1.3293 | −2.6576 | 11.8818 | −0.7128 | 2.0974 | 11.8818 |
| 1.3526 | −2.6942 | 11.8818 | −0.714 | 2.1421 | 11.8818 |
| 1.372 | −2.7241 | 11.8818 | −0.7123 | 2.1756 | 11.8818 |
| 1.3875 | −2.7479 | 11.8818 | −0.7083 | 2.2004 | 11.8818 |
| 1.3996 | −2.7662 | 11.8818 | −0.7039 | 2.2136 | 11.8818 |
| 1.4081 | −2.7803 | 11.8818 | −0.6993 | 2.2213 | 11.8818 |
| 1.4096 | −2.7938 | 11.8818 | −0.6959 | 2.2242 | 11.8818 |
| 1.4062 | −2.8042 | 11.8818 | −0.6939 | 2.2251 | 11.8818 |

It will be appreciated that the airfoil 105 disclosed in the above scalable TABLE 1 may be non-scaled, scaled up, or scaled down geometrically for use in other or similar turbine/compressor designs. Consequently, the coordinate values set forth in TABLE 1 may be non-scaled, scaled upwardly, or scaled downwardly such that the general airfoil profile shape remains unchanged. A scaled version of the coordinates in TABLE 1 would be represented by X, Y, and Z coordinate values of TABLE 1, with the X, Y, and Z non-dimensional coordinate values converted to inches or millimeters (or any suitable dimensional system), multiplied or divided by a constant number. The constant number may be a fraction, decimal fraction, integer or mixed number.

The disclosed airfoil shape thus may increase reliability and may be specific to the machine conditions and specifications. The airfoil shape provides a unique profile to achieve (1) interaction between other stages in the compressor; (2) aerodynamic efficiency; and (3) normalized aerodynamic and mechanical blade or vane loadings. The disclosed loci of points allow the gas turbine and the compressor or any other suitable turbine/compressor to run in an efficient, safe and smooth manner. As also noted, any scale of the disclosed airfoil may be adopted as long as (1) interaction between other stages in the compressor; (2) aerodynamic efficiency; and (3) normalized aerodynamic and mechanical blade loadings are maintained in the scaled compressor.

The airfoil 105 described herein thus improves overall compressor efficiency. Specifically, the airfoil 105 may provide the desired turbine/compressor efficiency lapse rate (ISO, hot, cold, part load, etc.). The airfoil 105 also meets all aeromechanics, loading and stress requirements.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. An article of manufacture having a nominal airfoil profile substantially in accordance with Cartesian coordinate values of X, Y, and Z set forth in scalable TABLE 1 relative to an origin at a mid-point of a suction side of a base of an airfoil, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete airfoil shape.

2. The article of manufacture according to claim 1, wherein the article of manufacture comprises an airfoil.

3. The article of manufacture according to claim 1, wherein the article of manufacture comprises a rotor blade configured for use with a compressor.

4. The article of manufacture according to claim 1, wherein the airfoil shape lies in an envelope within +/−5% of a chord length in a direction normal to an airfoil surface location.

5. The article of manufacture according to claim 1, wherein the number, used to convert the non-dimensional values to dimensional distances, is at least one of a fraction, a decimal fraction, an integer, and a mixed number.

6. The article of manufacture according to claim 1, wherein a height of the article of manufacture is about 1 inch to about 20 inches.

7. An article of manufacture having a suction-side nominal airfoil profile substantially in accordance with suction-side Cartesian coordinate values of X, Y, and Z set forth in scalable TABLE 1 relative to an origin at a mid-point of a suction side of a base of an airfoil, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete suction-side airfoil shape, the X, Y, and Z coordinate values being scalable as a function of the number to provide at least one of a non-scaled, scaled-up, and scaled-down airfoil profile.

8. The article of manufacture according to claim 7, wherein the article of manufacture comprises an airfoil.

9. The article of manufacture according to claim 7, wherein the article of manufacture comprises a rotor blade configured for use with a compressor.

10. The article of manufacture according to claim 7, wherein the suction-side airfoil shape lies in an envelope within +/−5% of a chord length in a direction normal to a suction-side airfoil surface location.

11. The article of manufacture according to claim 7, wherein the number, used to convert the non-dimensional values to dimensional distances, is at least one of a fraction, a decimal fraction, an integer, and a mixed number.

12. The article of manufacture according to claim 7, wherein a height of the article of manufacture is about 1 inch to about 20 inches.

13. The article of manufacture according to claim 7, further comprising the article of manufacture having a pressure-side nominal airfoil profile substantially in accordance with pressure-side Cartesian coordinate values of X, Y, and Z set forth in the scalable table, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete pressure-side airfoil shape, the X, Y, and Z values being scalable as a function of the number to provide at least one of a non-scaled, scaled-up, and scaled-down airfoil.

14. A compressor comprising a plurality of rotor blades, each of the rotor blades including an airfoil having a suction-side airfoil shape, the airfoil having a nominal profile substantially in accordance with suction-side Cartesian coordinate values of X, Y, and Z set forth in scalable TABLE 1 relative to an origin at a mid-point of a suction side of a base of an airfoil, wherein the Cartesian coordinate values of X, Y, and Z are non-dimensional values convertible to dimensional distances by multiplying the Cartesian coordinate values of X, Y, and Z by a number, and wherein X and Y are coordinates which, when connected by continuing arcs, define airfoil profile sections at each Z height, the airfoil profile sections at each Z height being joined with one another to form a complete suction-side airfoil shape.

15. The compressor according to claim 14, wherein the suction-side airfoil shape lies in an envelope within +/−5% of a chord length in a direction normal to a suction-side airfoil surface location.

16. The compressor according to claim 14, wherein the number, used to convert the non-dimensional values to dimensional distances, is at least one of a fraction, a decimal fraction, an integer, and a mixed number.

17. The compressor according to claim 14, wherein a height of each rotor blade is about 1 inch to about 20 inches.

18. The compressor according to claim 14, further comprising each of the plurality of rotor blades having a pressure-side nominal airfoil profile substantially in accordance with pressure-side Cartesian coordinate values of X, Y, and Z set forth in the scalable table, wherein the Cartesian coordinate values of X, Y, and Z are non-dimensional values convertible to dimensional distances by multiplying the Cartesian coordinate values of X, Y, and Z by the number, and wherein X and Y are coordinates which, when connected by continuing arcs, define airfoil profile sections at each Z height, the airfoil profile sections at each Z height being joined with one another to form a complete pressure-side airfoil shape.

19. The compressor according to claim 18, wherein the pressure-side airfoil shape lies in an envelope within +/−5% of a chord length in a direction normal to a pressure-side airfoil surface location.

20. The compressor according to claim 18, wherein the number, used to convert the non-dimensional values to dimensional distances, is at least one of a fraction, a decimal fraction, an integer, and a mixed number.

* * * * *